US010036111B2

(12) United States Patent
Ryu et al.

(10) Patent No.: US 10,036,111 B2
(45) **Date of Patent: *Jul. 31, 2018**

(54) BALANCER AND WASHING MACHINE HAVING THE SAME

(71) Applicant: SAMSUNG ELECTRONICS CO., LTD., Suwon-si, Gyeonggi-do (KR)

(72) Inventors: Doo Young Ryu, Suwon-si (KR); Won Young Jung, Seoul (KR); Young Jin Cho, Seongnam-si (KR); Jeong Hoon Kang, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 522 days.

This patent is subject to a terminal disclaimer.

(21) Appl. No.: 14/163,373

(22) Filed: Jan. 24, 2014

(65) Prior Publication Data

US 2014/0208808 A1 Jul. 31, 2014

(30) Foreign Application Priority Data

Jan. 25, 2013 (KR) ..... 10-2013-0008722

(51) Int. Cl.
*D06F 37/22* (2006.01)
*D06F 37/24* (2006.01)

(52) U.S. Cl.
CPC ..... *D06F 37/225* (2013.01); *D06F 37/22* (2013.01); *D06F 37/245* (2013.01); *D06F 2222/00* (2013.01)

(58) Field of Classification Search
CPC ..... D06F 37/22; D06F 37/225; D06F 2222/00
See application file for complete search history.

(56) References Cited

U.S. PATENT DOCUMENTS 4,810,987 A * 3/1989 Liebthal ..... H01F 7/0252 335/302
6,061,325 A * 5/2000 Zaun ..... F16F 15/363 360/99.08
6,373,154 B1 * 4/2002 Sohn ..... F16F 15/363 310/51
8,427,264 B1 * 4/2013 Martorell ..... B29C 45/14065 264/272.15

(Continued)

FOREIGN PATENT DOCUMENTS

CN 102443999 5/2012
EP 2 752 516 A1 7/2014

(Continued)

OTHER PUBLICATIONS

Machine translation of KR 10-2008-0037428, no date.*
International Search Report dated May 7, 2014 in corresponding Application No. PCT/KR2014/000580.
European Office Action dated Oct. 20, 2015 in corresponding European Patent Application No. 14152406.6.
European Decision on Grant dated Jul. 7, 2016 from European Patent Application No. 14152406.6, 68 pages.
Australian Notice of Acceptance dated Aug. 2, 2016 from Australian Patent Application No. 2014210512, 2 pages.

(Continued)

*Primary Examiner* — Joseph L. Perrin
(74) *Attorney, Agent, or Firm* — Staas & Halsey LLP

(57) ABSTRACT

A balancer includes a balancer housing coupled to a drum of a washing machine, the balancer housing having an annular channel defined therein, at least one mass movably disposed in the channel, at least one magnet to restrain movement of the mass along the channel when rotational speed of the drum is within a predetermined range, and at least one magnet fixing member coupled to an outside of the balancer housing to receive and fix the magnet.

30 Claims, 37 Drawing Sheets

(56) References Cited

U.S. PATENT DOCUMENTS

| | | | | |
|---|---|---|---|---|
| 2001/0038601 | A1* | 11/2001 | Kikuchi | F16F 15/363 720/701 |
| 2002/0176351 | A1* | 11/2002 | Masaki | F16F 15/363 720/702 |
| 2005/0126230 | A1 | 6/2005 | Choi | |
| 2009/0201112 | A1* | 8/2009 | Sample | B29C 70/72 335/296 |
| 2012/0084926 | A1 | 4/2012 | Lee et al. | |
| 2012/0192362 | A1* | 8/2012 | Lee | D06F 37/203 8/137 |

FOREIGN PATENT DOCUMENTS

| | | |
|---|---|---|
| JP | 3-261500 | 11/1991 |
| JP | 2010-264103 | 11/2010 |
| KR | 10-2008-0037428 | 4/2008 |
| SU | 1461796 | 2/1989 |
| WO | WO 2005/075726 | 8/2005 |
| WO | 2014/107004 | 7/2014 |
| WO | 2014/116016 A1 | 7/2014 |

OTHER PUBLICATIONS

Russian Decision on Grant dated Sep. 16, 2016 from Russian Patent Application No. 2015130673/12(047216), 14 pages.

Chinese Office Action dated Dec. 27, 2016 from Chinese Patent Application No. 201410037030.X, 12 pages.

Chinese Notification of Granting of Patent Right to Invention dated Sep. 8, 2017 in corresponding Chinese Patent Application No. 201410037030.X.

* cited by examiner

BALANCER AND WASHING MACHINE HAVING THE SAME

CROSS-REFERENCE TO RELATED APPLICATIONS

This application claims the benefit of Korean Patent Application No. 10-2013-0008722, filed on Jan. 25, 2013 in the Korean Intellectual Property Office, the disclosure of which is incorporated herein by reference.

BACKGROUND

1. Field

Embodiments of the present disclosure relate to a washing machine having a balancer to offset unbalanced load generated during rotation of a drum.

2. Description of the Related Art

A washing machine is a machine that washes clothes using electric power. Generally, the washing machine includes a cabinet forming the external appearance of the washing machine, a tub to contain wash water in the cabinet, a drum rotatably installed in the tub, and a motor to rotate the drum.

When the drum is rotated by the motor in a state in which laundry is put in the drum together with detergent water, contaminants are removed from the laundry by friction between the laundry and the drum and between the laundry and wash water.

If the laundry is not uniformly distributed in the drum but accumulates at one side during rotation of the drum, vibration and noise are generated due to eccentric rotation of the drum. According to circumstances, parts, such as the drum or the motor, of the washing machine may be damaged.

For this reason, the washing machine has a balancer that offsets unbalanced load generated in the drum to stabilize rotation of the drum.

SUMMARY

It is an aspect of the present disclosure to provide a balancer with improved performance and a washing machine having the same.

Additional aspects of the disclosure will be set forth in part in the description which follows and, in part, will be apparent from the description, or may be learned by practice of the disclosure.

In accordance with one aspect of the present disclosure, a balancer, mounted to a drum of a washing machine to offset unbalanced load generated in the drum during rotation of the drum, includes a balancer housing coupled to the drum, the balancer housing having an annular channel defined therein, at least one mass movably disposed in the channel, at least one magnet to restrain movement of the mass along the channel when rotational speed of the drum is within a predetermined range, and at least one magnet fixing member to receive and fix the magnet, the magnet fixing member being coupled to an outside of the balancer housing.

The magnet fixing member may include two or more magnet fixing members arranged in a circumferential direction of the balancer housing at intervals.

The magnet fixing member may extend in a circumferential direction of the balancer housing to receive two or more magnets.

The magnet fixing member may include two or more magnet fixing members disposed symmetrically on the basis of a virtual line passing through a center of rotation of the drum.

The balancer housing may include a first housing opened at one side thereof and a second housing to cover the first housing to define the annular channel and the magnet fixing member may be coupled to an outside of the first housing.

The magnet fixing member may be coupled to a rear surface of the balancer housing opposite to a front surface of the drum.

The magnet fixing member may include a first magnet support part to support one major surface of the magnet and a second magnet support part protruding from the first magnet support part to support a side surface of the magnet.

The second magnet support part may have a width gradually increasing in a protruding direction of the second magnet support part.

The magnet may be provided at the side surface thereof with an inclined part supported by the second magnet support part.

The balancer may include a third magnet support part protruding from an inner surface of the second magnet support part to support the other major surface of the magnet opposite to one major surface of the magnet.

The magnet may be provided at the side surface thereof with a stepped part supported by the third magnet support part.

The magnet fixing member may be coupled to the outside of the balancer housing by welding.

The balancer may include at least one fastening protrusion protruding from the outside of the balancer housing, wherein the magnet fixing member may include at least one fastening hook coupled to the fastening protrusion.

The balancer may further include at least one fastening groove formed by cutting at least a portion of the fastening protrusion, wherein the magnet fixing member may include at least one fastening rib coupled to the fastening groove.

The fastening groove may be formed by cutting at least a portion of the fastening protrusion in a radial direction of the balancer housing.

The fastening rib and the fastening hook may be disposed at each end of the magnet fixing member.

The balancer may include a connection rib extending from one end of the magnet fixing member in a circumferential direction of the magnet fixing member to connect one end of the magnet fixing member to the fastening rib.

The fastening rib and the fastening hook may extend from the connection rib in a direction in which the magnet fixing member is coupled to the balancer housing.

The balancer may include at least one fixing member fastening part protruding from the outer surface of the balancer housing in a shape corresponding to an external shape of the magnet fixing member and at least one fixing member fastening groove provided at the fixing member fastening part, wherein the magnet fixing member may include at least one fixing member fastening hook coupled to the fixing member fastening groove.

The magnet fixing member may include a first magnet support part to support one major surface of the magnet and a second magnet support part protruding from the first magnet support part to support a side surface of the magnet and the fixing member fastening hook may extend from an end of the second magnet support part in a direction in which the magnet fixing member is coupled to the balancer housing.

The magnet fixing member may include a plurality of magnet fixing hooks to fix the at least one magnet received therein and the magnet fixing hooks may be arranged along the second magnet support part at intervals.

The balancer may include at least one fastening hook protruding from the outer surface of the balancer housing, wherein the magnet fixing member may include at least one fastening hole, to which the fastening hook is coupled.

The magnet fixing member may include a plurality of extension parts extending from opposite ends thereof in a circumferential direction of the magnet fixing member and the fastening hole may be formed through each of the extension parts.

The magnet may be inserted into a mold to form the magnet fixing member.

In accordance with another aspect of the present disclosure, a washing machine includes a cabinet, a drum rotatably disposed in the cabinet, an annular recess provided at the drum, and a balancer to offset unbalanced load generated in the drum during rotation of the drum, wherein the balancer includes a balancer housing mounted in the recess, the balancer housing having an annular channel defined therein, at least one mass movably disposed in the channel, at least one magnet to restrain the mass when rotational speed of the drum is within a predetermined range, and at least one magnet case to receive the magnet, the magnet case being coupled to an outside of the balancer housing.

The magnet case may be coupled and fixed to a rear surface of the balancer housing opposite to the recess.

The magnet case may include at least one magnet receiving part to receive the magnet and a plurality of magnet support parts to support the magnet received in the magnet receiving part in at least two directions.

The magnet support parts may include a first magnet support part to support one major surface of the magnet and a second magnet support part protruding from the first magnet support part to support a side surface of the magnet.

The second magnet support part may have an inclined inner surface.

The second magnet support part may have a stepped inner surface.

The magnet receiving part may include two or more magnet receiving parts arranged in a circumferential direction of the magnet case.

The magnet case may be coupled to the balancer housing in a radial direction of the balancer housing.

The magnet case may be coupled to the balancer housing in a direction opposite to a direction in which the balancer housing is coupled to the recess.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
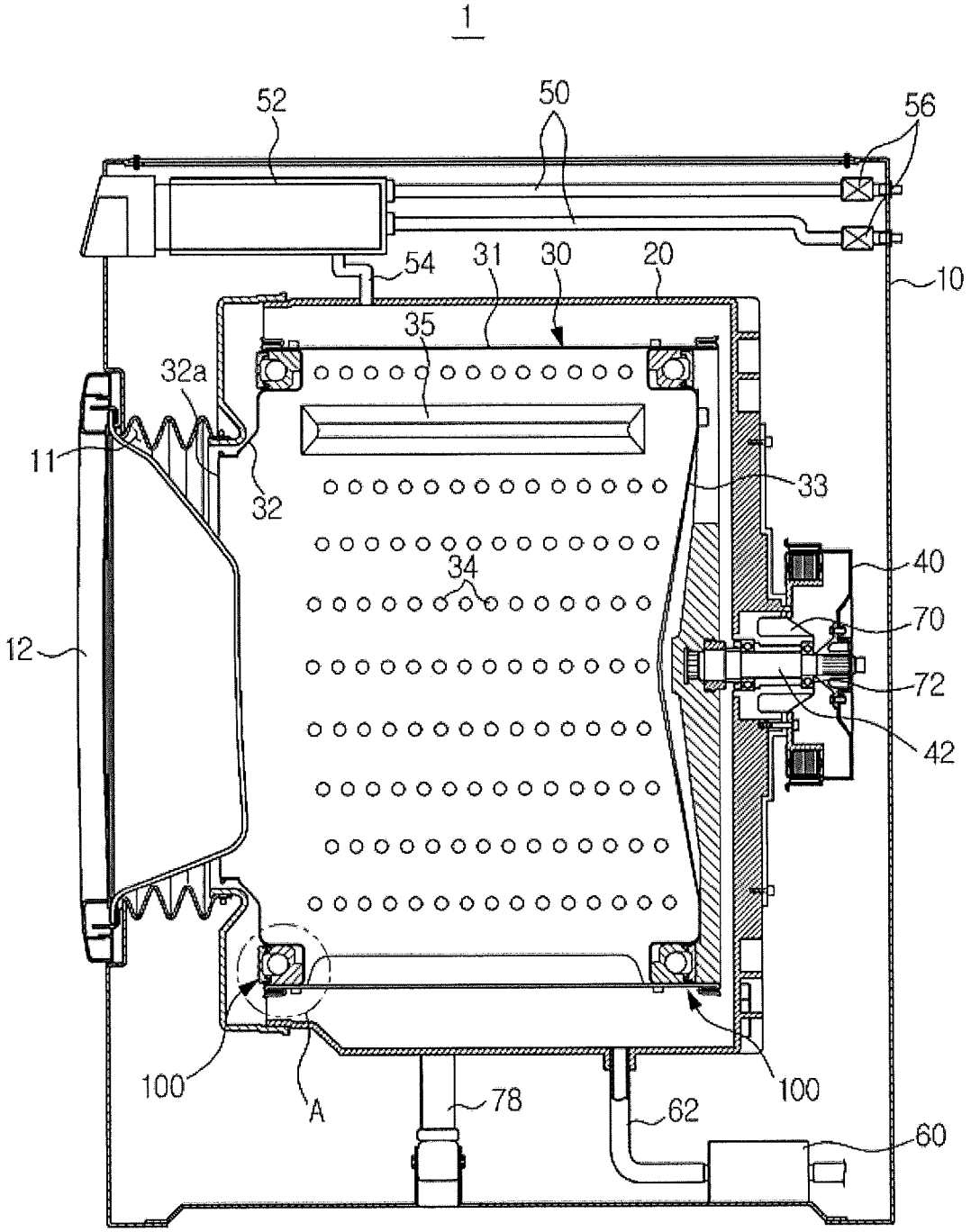
FIG. 1 is a view showing the construction of a washing machine according to an embodiment of the present disclosure.

Reference will now be made in detail to the embodiments of the present disclosure, examples of which are illustrated in the accompanying drawings, wherein like reference numerals refer to like elements throughout.

FIG. 1 is a view showing the construction of a washing machine according to an embodiment of the present disclosure.

As shown in FIG. 1, a washing machine 1 includes a cabinet 10 forming the external appearance thereof, a tub 20 disposed in the cabinet 10, a drum 30 rotatably disposed in the tub 20, and a motor 40 to drive the drum 30.

An introduction port 11, through which laundry is introduced into the drum 30, is formed at the front of the cabinet 10. The introduction port 11 is opened and closed by a door 12 installed at the front part of the cabinet 10.

Above the tub 20 is installed a water supply pipe 50 to supply wash water to the tub 20. One side of the water supply pipe 50 is connected to a water supply valve 56 and the other side of the water supply pipe 50 is connected to a detergent supply unit 52.

The detergent supply unit 52 is connected to the tub 20 via a connection pipe 54. Water, supplied through the water supply pipe 50, is supplied into the tub 20 together with detergent via the detergent supply unit 52.

Under the tub 20 are provided a drainage pump 60 and a drainage pipe 62 to discharge water in the tub 20 from the cabinet 10.

The drum 30 includes a cylinder part 31, a front plate 32 disposed at the front of the cylinder part 31, and a rear plate 33 disposed at the rear of the cylinder part 31. An opening 32*a*, through which laundry is introduced and removed, is formed at the front plate 32. A drive shaft 42 to transmit power from the motor 40 to the drum 30 is connected to the rear plate 33.

The drum 30 is provided at the circumference thereof with a plurality of through holes 34, through which wash water flows. The drum 30 is provided at the inner circumference thereof with a plurality of lifters 35, by which laundry is raised and dropped when the drum 30 is rotated.

The drive shaft 42 is disposed between the drum 30 and the motor 40. One end of the drive shaft 42 is connected to the rear plate 33 of the drum 30 and the other end of the drive shaft 42 extends to the outside of the rear wall of the tub 20. When the drive shaft 42 is driven by the motor 40, the drum 30 connected to the drive shaft 42 is rotated about the drive shaft 42.

At the rear wall of the tub 20 is installed a bearing housing 70 to rotatably support the drive shaft 42. The bearing housing 70 may be made of an aluminum alloy. The bearing housing 70 may be inserted into the rear wall of the tub 20 when the tub 20 is injection molded. Between the bearing housing 70 and the drive shaft 42 are installed bearings 72 to smoothly rotate the drive shaft 42.

The tub 20 is supported by a damper 78. The damper 78 is connected between the inside bottom of the cabinet 10 and the outer surface of the tub 20.

During a washing cycle, the motor 40 rotates the drum 30 in alternating directions at low speed. As a result, laundry in the drum 30 is repeatedly raised and dropped so that contaminants are removed from the laundry.

During a spin-drying cycle, the motor 40 rotates the drum 30 in one direction at high speed. As a result, water is separated from laundry by centrifugal force applied to the laundry.

If the laundry is not uniformly distributed in the drum 30 but accumulates at one side when the drum 30 is rotated during spin-drying, rotation of the drum 30 is unstable, generating vibration and noise.

For this reason, the washing machine 1 includes a balancer 100 to stabilize rotation of the drum 30.

Figure 2:
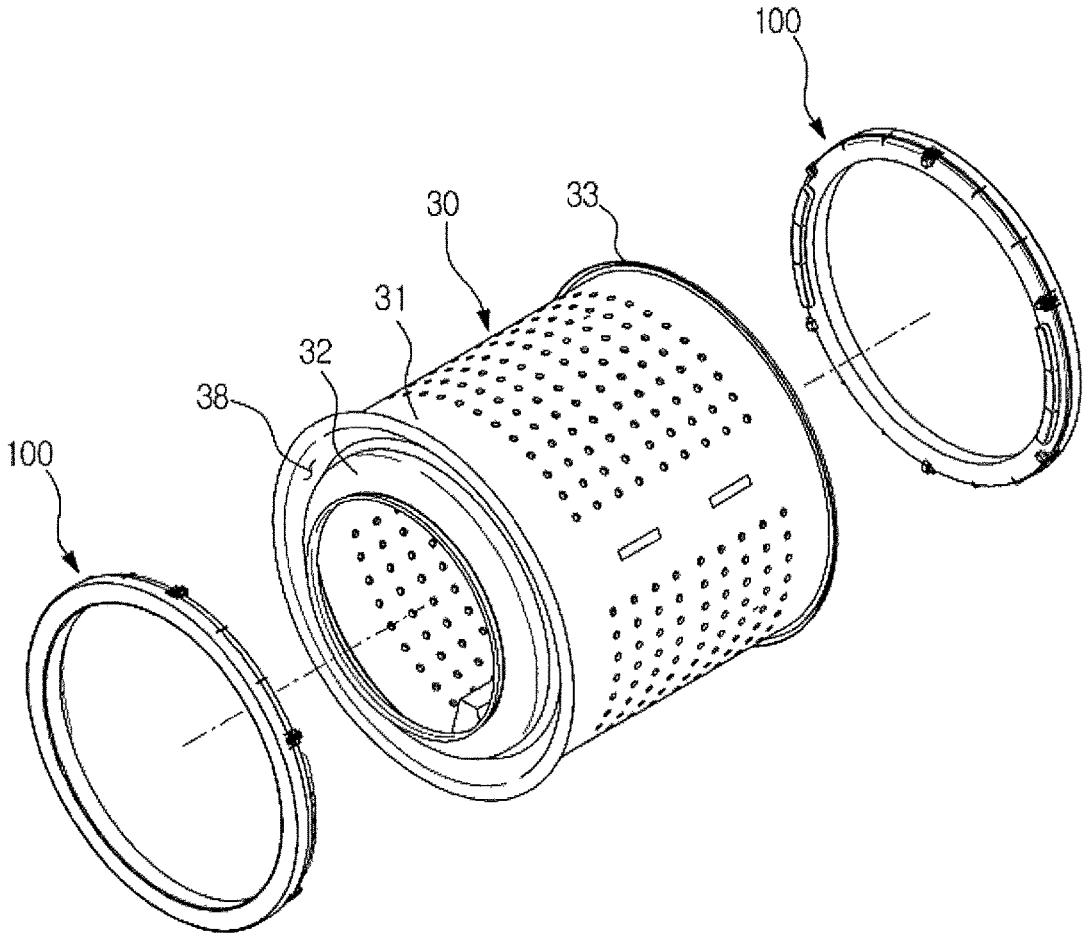
FIG. 2 is an exploded perspective view showing a drum and a balancer according to an embodiment of the present disclosure.
Figure 3:
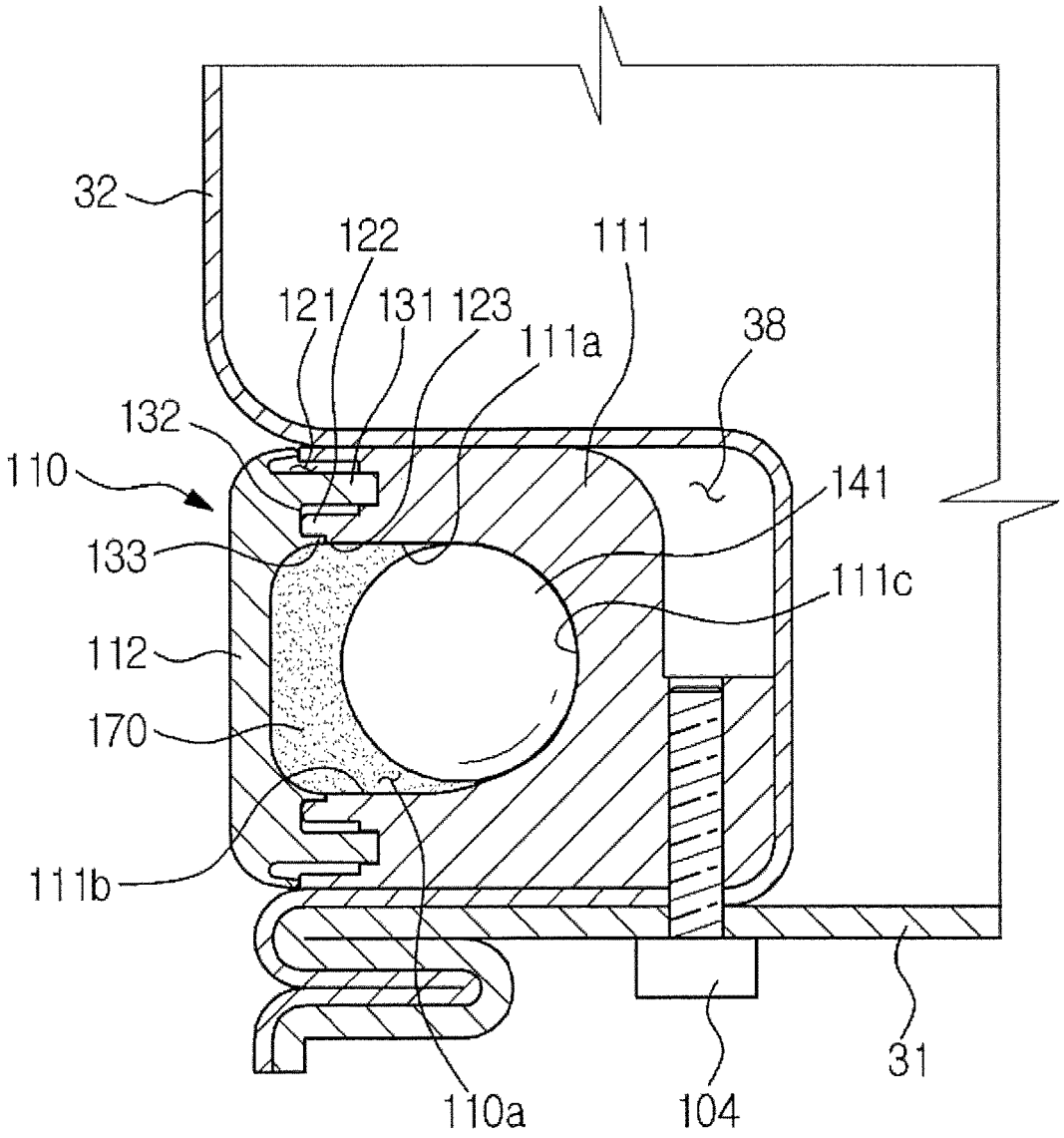
FIG. 3 is an enlarged view showing part A of FIG. 1.
Figure 4:
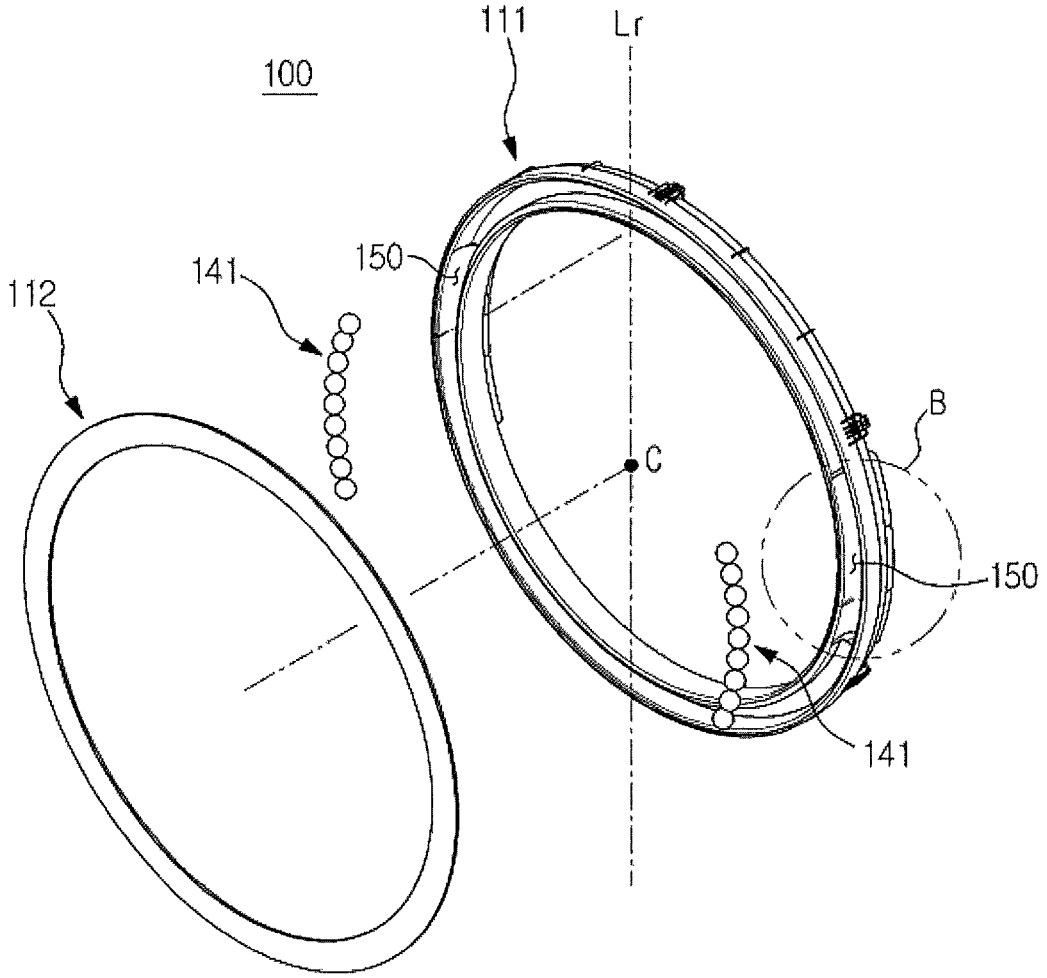
FIG. 4 is an exploded perspective view of the balancer shown in FIG. 2.
Figure 5:
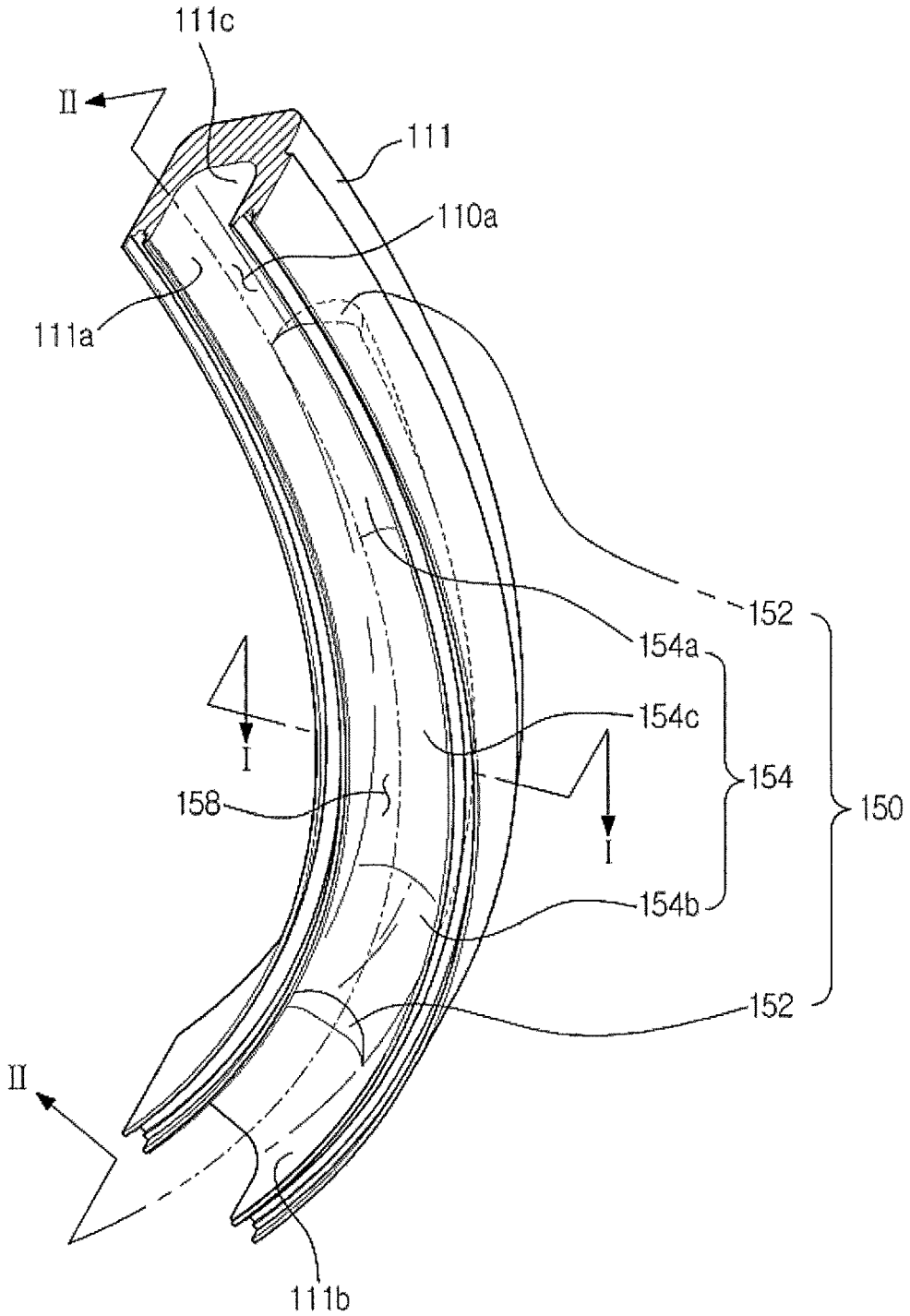
FIG. 5 is an enlarged view showing part B of FIG. 4.
Figure 6:
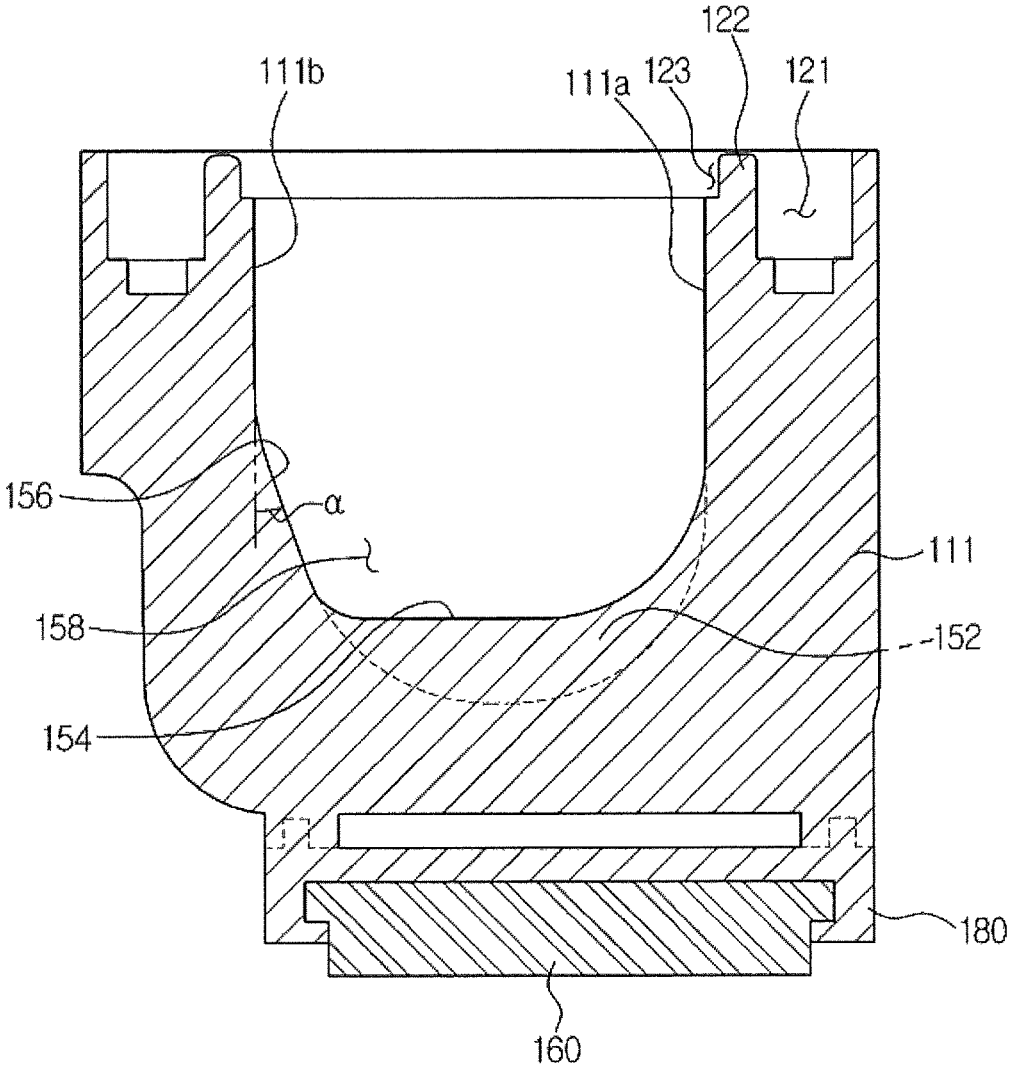
FIG. 6 is a sectional view taken along line I-I of FIG. 5.
Figure 7:
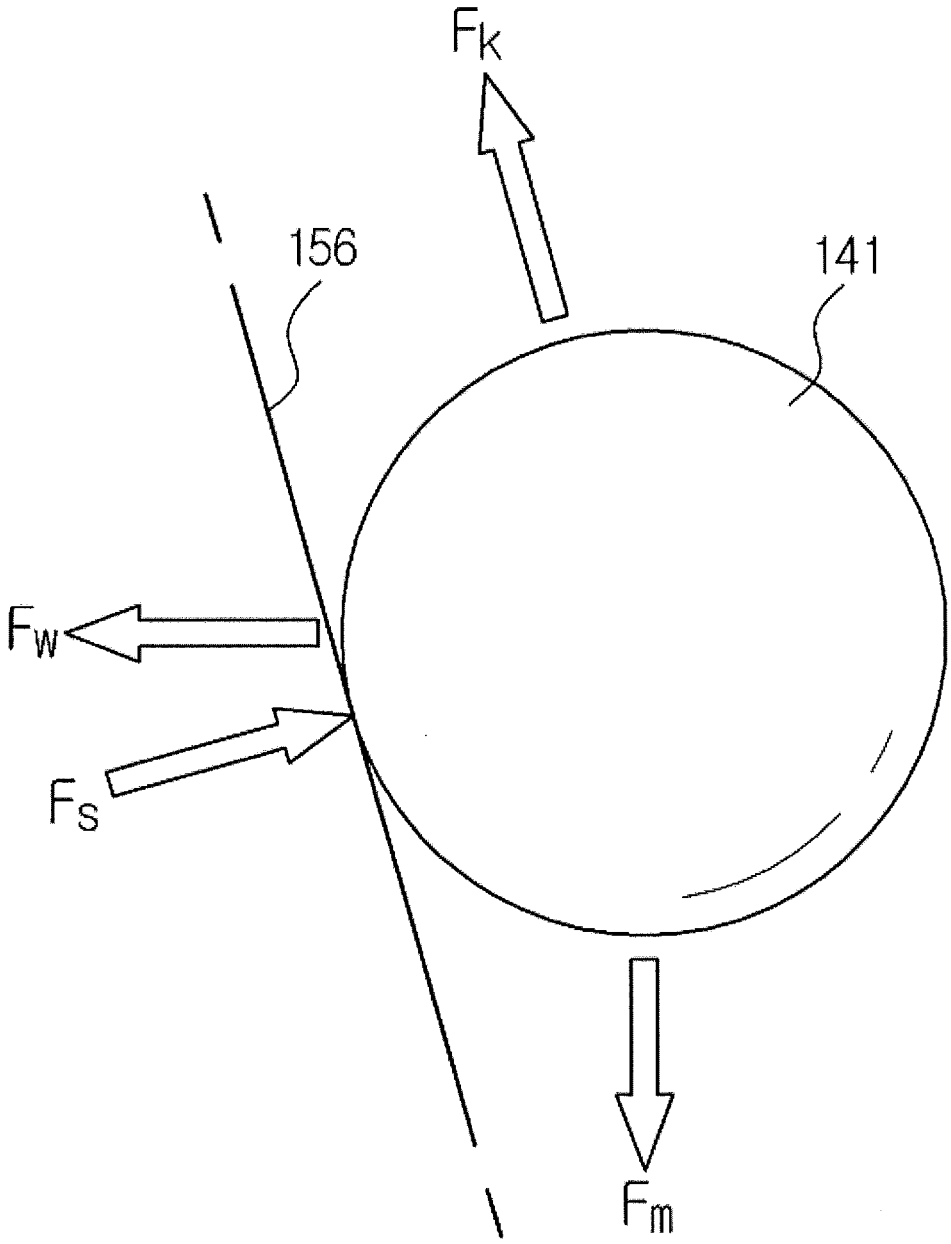
FIG. 7 is a view illustrating a relationship among centrifugal force, magnetic force, and supporting force generated by an inclined sidewall.
Figure 8:
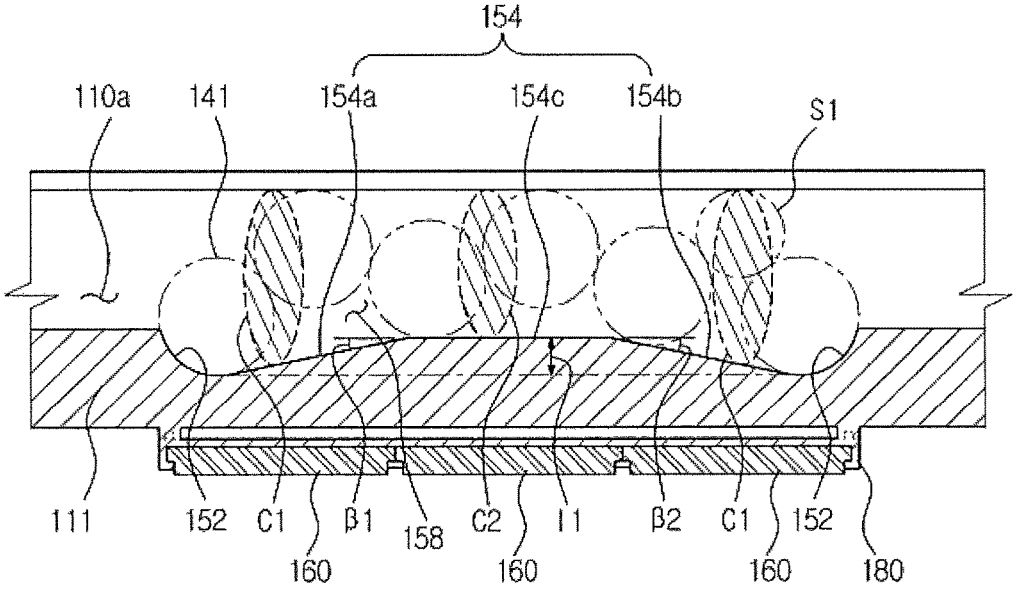
FIG. 8 is a sectional view taken along line II-II of FIG. 5.

FIG. 2 is an exploded perspective view showing the drum and a balancer according to an embodiment of the present disclosure and FIG. 3 is an enlarged view showing part A of FIG. 1. FIG. 4 is an exploded perspective view of the balancer shown in FIG. 2 and FIG. 5 is an enlarged view showing part B of FIG. 4. FIG. 6 is a sectional view taken along line I-I of FIG. 5, FIG. 7 is a view illustrating a relationship among centrifugal force, magnetic force, and supporting force generated by an inclined sidewall, and FIG. 8 is a sectional view taken along line II-II of FIG. 5.

The balancer 100 may be mounted to the front plate 32 and/or the rear plate 33 of the drum 30. The balancer 100 mounted to the front plate 32 and the balancer 100 mounted to the rear plate 33 are the same. Hereinafter, therefore, a description will be given of the balancer 100 mounted to the front plate 32.

As shown in FIGS. 1 to 8, the balancer 100 includes a balancer housing 110 having an annular channel 110*a* and a plurality of masses 141 disposed in the annular channel 110*a* such that the masses 141 move along the annular channel 110*a* to perform a balancing function of the drum 30.

An annular recess 38, which is open at the front thereof, is formed at the front plate 32 of the drum 30. The balancer housing 110 is received in the recess 38. The balancer housing 110 may be coupled to the drum 30 by fixing members 104 such that the balancer housing 110 is securely fixed to the drum 30.

The balancer housing 110 includes a first annular housing 111 opened at one side thereof and a second housing 112 to cover the opening of the first housing 111. The inner surface of the first housing 111 and the inner surface of the second housing 112 define the annular channel 110*a*. The first housing 111 and the second housing 112 may be manufactured by injection molding of plastic, such as polypropylene (PP) or acrylonitrile butadiene styrene (ABS). In addition, the first housing 111 and the second housing 112 may be thermally welded to each other. In the following, the front surface of the balancer housing 110 is defined as a surface exposed forward when the balancer housing 110 is coupled to the drum 30 and the rear surface of the balancer housing 110, which is opposite to the front surface of the balancer housing 110, is defined as a surface facing the front plate 32 of the drum 30 when the balancer housing 110 is coupled to the drum 30. In addition, the side surface of the balancer housing 110 is defined as a surface connected between the front surface and the rear surface of the balancer housing 110.

The first housing 111 has first coupling grooves 121 formed at opposite sides of the channel 110*a* and the second housing 112 has first coupling protrusions 131 coupled in the first coupling grooves 121. Second coupling protrusions 122 are formed between the first coupling grooves 121 of the first housing 111 and the channel 110*a*. The second coupling protrusions 122 of the first housing 111 are coupled in second coupling grooves 132 formed at the insides of the first coupling protrusions 131 of the second housing 112. Third coupling grooves 123 are formed at the insides of the second coupling protrusions 122 adjacent to the channel 110*a* and the second housing 112 has third coupling protrusions 133 coupled in the third coupling grooves 123. In the above coupling structure, the first housing 111 and the second housing 112 may be securely coupled to each other and, in a case in which a fluid, such as oil, is contained in the channel 110*a*, leakage of the fluid may be prevented.

The first housing 111 includes a first inner surface 111*a* and a second inner surface 111*b*, which are opposite to each other, and a third inner surface 111*c* connected between the first inner surface 111*a* and the second inner surface 111*b*.

At least one selected from among the first inner surface 111*a*, the second inner surface 111*b*, and the third inner surface 111*c* is provided with a groove 150, in which the masses 141 are located such that the masses 141 are temporarily restrained. In FIGS. 2 to 8, the groove 150 is formed in the first inner surface 111*a* and the third inner surface 111*c*. However, embodiments of the present disclosure are not limited thereto. For example, the groove 150 may be formed in any one selected from among the first inner surface 111*a*, the second inner surface 111*b*, and the third inner surface 111*c*, in the first inner surface 111*a* and the third inner surface 111*c*, or in the first inner surface 111*a*, the second inner surface 111*b*, and the third inner surface 111*c*.

In order to prevent unbalanced load from being generated in the drum 30 due to the masses 141 in a state in which the masses 141 are located in each groove 150, grooves 150 may be disposed symmetrically on the basis of a virtual line Lr passing through a center of rotation C of the drum 30 and perpendicular to the ground.

The groove 150 extends in a circumferential direction of the balancer housing 110 to receive at least two masses 141. The groove 150 includes first support parts 152 to support the masses 141 approximately in the circumferential direction and a radial direction of the balancer housing 110, a second support part 154 provided between the first support parts 152 to support the masses 141 approximately in the radial direction of the balancer housing 110, inclined surfaces 154*a* and 154*b* inclined inwardly of the channel 110*a* of the balancer housing 110, and at least one flat surface 154*c* provided between the inclined surfaces 154*a* and 154*b*.

The first support parts 152 are provided at the opposite ends of the groove 150 in the form of a step projection to prevent the masses 141 from being separated from the groove 150 when the number of rotations of the drum 30 is within a predetermined range.

The second support part 154 protrudes inwardly of the channel 110*a*. The inclined surfaces 154*a* and 154*b* and the flat surface 154*c* are provided at the second support part 154. The inclined surfaces 154*a* and 154*b* include a first inclined surface 154*a* and a second inclined surface 154*b* disposed in a state in which the flat surface 154*c* is located between the first inclined surface 154*a* and the second inclined surface 154*b*. Opposite ends of the first inclined surface 154*a* and the second inclined surface 154*b* are connected to the first support parts 152 and the flat surface 154*c*. A first inclination angle β1 between the flat surface 154*c* and the first inclined surface 154*a* may be different from a second inclination angle β2 between the flat surface 154*c* and the second inclined surface 154*b*. A length l1 of the second support part 154 protruding inwardly of the channel may be between 1 mm and 3 mm.

The channel 110*a* includes a section increase portion 158 formed at a region thereof where the groove 150 is formed. The section increase portion 158 is a space defined in the channel 110*a* by the groove 150. The section increase portion 158 is formed in a shape corresponding to at least a portion of the mass 141. In the same manner as in the groove 150, each section increase portion 158 may extend in the circumferential direction of the balancer housing 110 to receive at least two masses 141 and section increase portions 158 may be disposed symmetrically on the basis of a virtual line Lr passing through a center of rotation C of the drum 30.

A sectional area C1 at each end of the section increase portion 158 is greater than a sectional area C2 between opposite ends of the section increase portion 158 due to the first inclined surface 154*a*, the second inclined surface 154*b*, and the flat surface 154*c* provided at the second support part 154.

Since the second support part 154 is formed in a shape protruding inwardly of the channel 110*a*, a free space is generated between the masses 141 received in the groove 150 or the section increase portion 158. When the number of rotations per minute of the drum 30 deviates from a predetermined range, therefore, the masses 141 are smoothly separated from the groove 150 without sticking to the groove 150. As a result, the masses 141 move along the channel 110*a* to perform a balancing function of the drum 30.

An inclined sidewall 156 is provided at the second inner surface 111*b* corresponding to the first inner surface 111*a* in which the groove 150 is formed. As shown in FIG. 7, the inclined sidewall 156 generates supporting force Fs to support the mass 141 in a direction resisting centrifugal force Fw applied to the mass 141 during rotation of the drum 30. Consequently, the centrifugal force Fw applied to the mass 141 during rotation of the drum 30 is offset by the supporting force Fs of the inclined sidewall 156 applied to the mass 141. As will hereinafter be described, therefore, magnetic force Fm generated by the magnet 160 coupled to the rear surface of the balancer housing 110 offsets only force Fk formed at the mass 141 along the inclined sidewall 156. When the number of rotations of the drum 30 is within a predetermined range, therefore, the movement of the mass 141 may be restrained. As described above, the inclined sidewall 156 is provided at the second inner surface 111*b* corresponding to the first inner surface 111*a* in which the groove 150 is formed such that the centrifugal force Fw applied to the mass 141 during rotation of the drum 30 is offset by the inclined sidewall 156. Consequently, the movement of the mass 141 is effectively restrained and controlled even using magnetic force Fm having low intensity.

The inclined sidewall 156 may have an inclination angle α of about 5 to 25 degrees. Although not shown, the inclination angle α of the inclined sidewall 156 may be changed in the inner circumferential direction of the balancer housing 110. That is, the inclination angle α of the inclined sidewall 156 may be maintained at 5 degrees in a section of the inclined sidewall 156 and the inclination angle α of the inclined sidewall 156 may be maintained at an angle greater than 5 degrees or less than 25 degrees in another section of the inclined sidewall 156. In addition, the inclination angle α of the inclined sidewall 156 may be successively increased or decreased in the inner circumferential direction of the balancer housing 110. As described above, the inclination angle α of the inclined sidewall 156 is changed in the inner circumferential direction of the balancer housing 110, thereby preventing the masses 141 received in the groove 150 from sticking to the groove 150.

Each mass 141 is formed of a metal material having a spherical shape. The masses 141 are movably disposed along the annular channel 110*a* in the circumferential direction of the drum 30 to offset unbalanced load in the drum 30 during rotation of the drum 30. When the drum 30 is rotated, centrifugal force is applied to the masses 141 in a direction in which the radius of the drum 30 is increased and the masses 141, separated from the groove 150, move along the channel 110*a* to perform a balancing function of the drum 30.

The masses 141 are received in the first housing 111 before the first housing 111 and the second housing 112 are welded to each other. The masses 141 may be disposed in the balancer housing 110 by welding the first housing 111 and the second housing 112 to each other in a state in which the masses 141 are received in the first housing 111.

A damping fluid 170 to prevent abrupt movement of the masses 141 is contained in the balancer housing 110.

The damping fluid 170 applies resistance to the masses 141 when force is applied to the masses 141 to prevent the masses 141 from abruptly moving in the channel 110*a*. The damping fluid 170 may be oil. The damping fluid 170 partially performs a balancing function of the drum 30 together with the masses 141 during rotation of the drum 30.

The damping fluid 170 is injected into the first housing 111 together with the masses 141 and is received in the balancer housing 110 by welding the first housing 111 and the second housing 112 to each other. However, embodiments of the present disclosure are not limited thereto. For example, the first housing 111 and the second housing 112 may be welded to each other and then the damping fluid 170 may be injected into the balancer housing 110 through an injection port (not shown) formed at the first housing 111 or the second housing 112 such that the damping fluid 170 is received in the balancer housing 110.

At least one magnet 160 to restrain the masses 141 is provided at the rear surface of the balancer housing 110.

Figure 9:
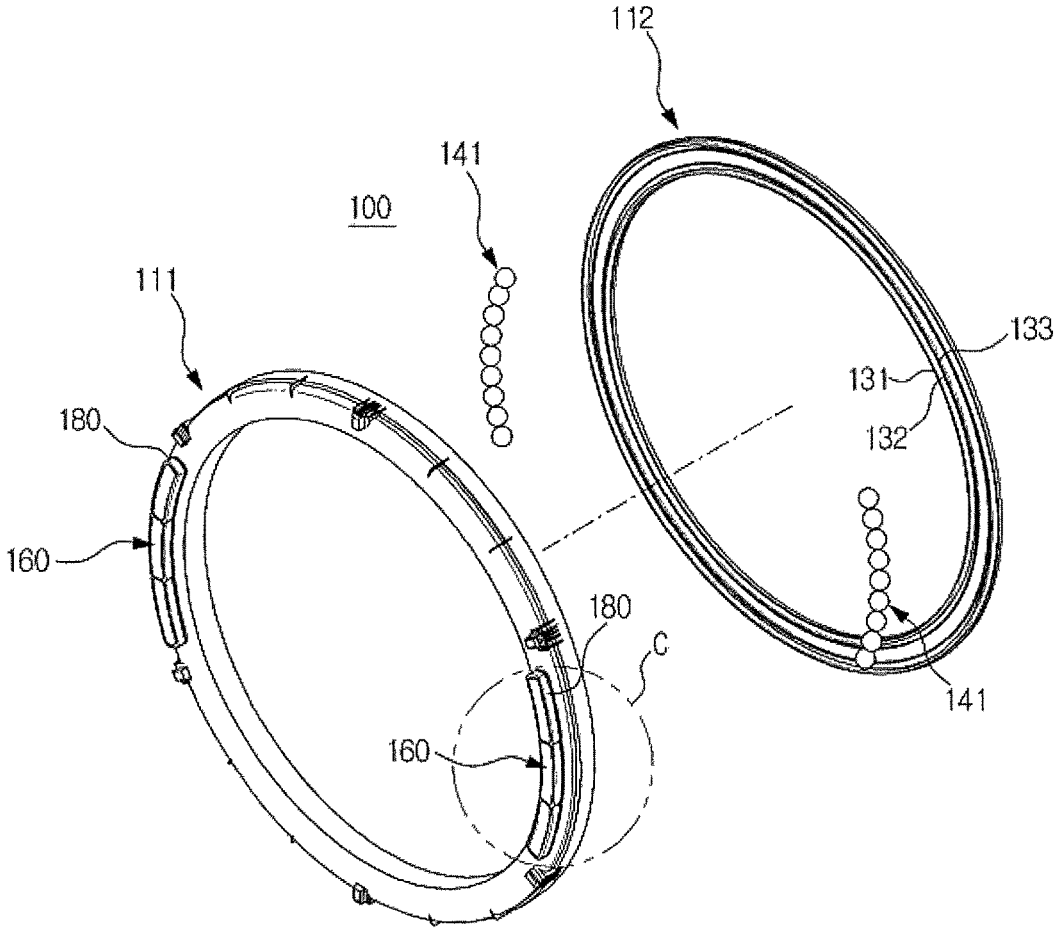
FIG. 9 is an exploded perspective view of FIG. 4 when viewed from another angle.
Figure 10:
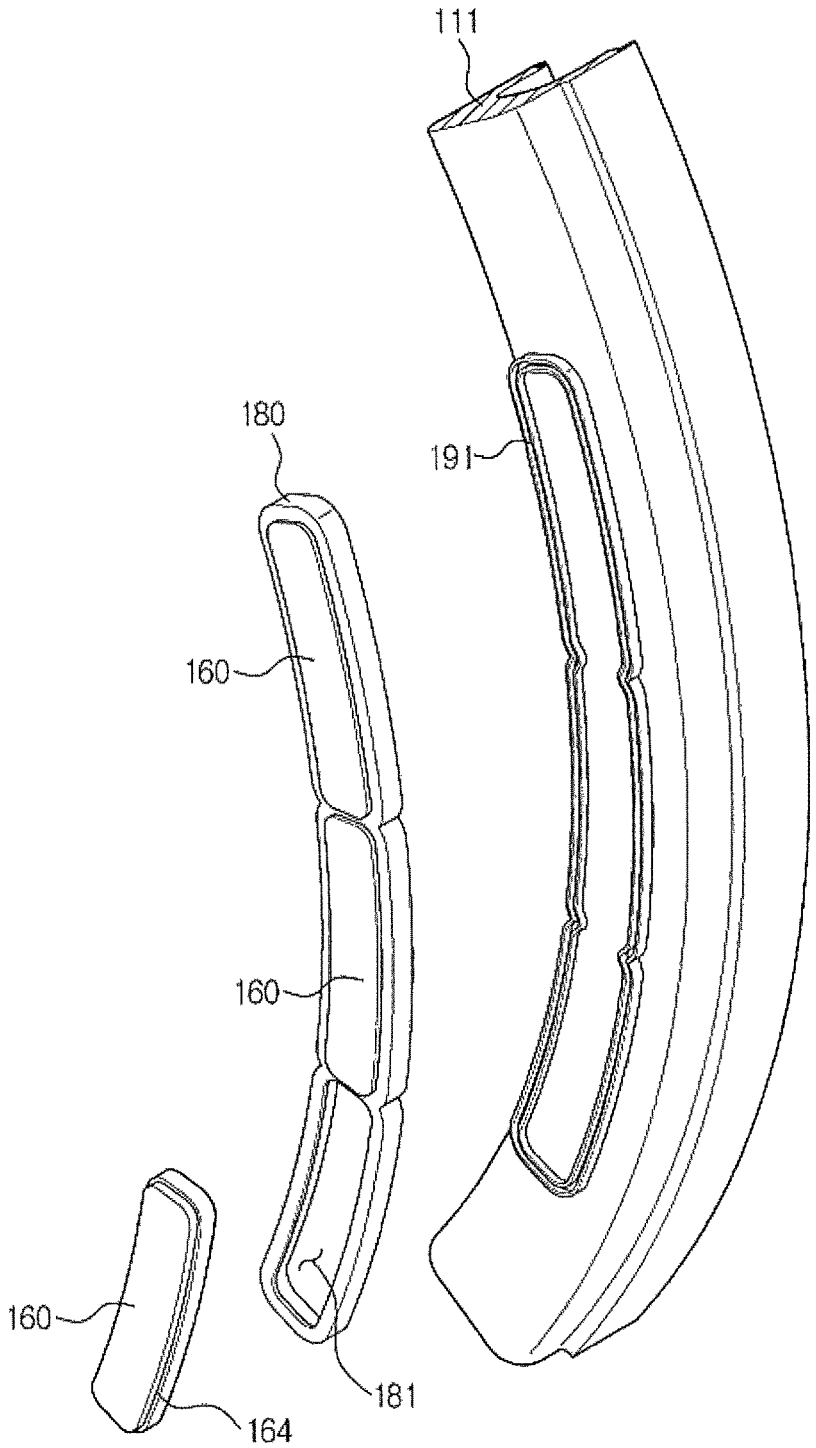
FIG. 10 is an enlarged view of part C of FIG. 9 showing a coupling relationship between a magnet fixing member according to an embodiment of the present disclosure and a balancer housing.
Figure 11:
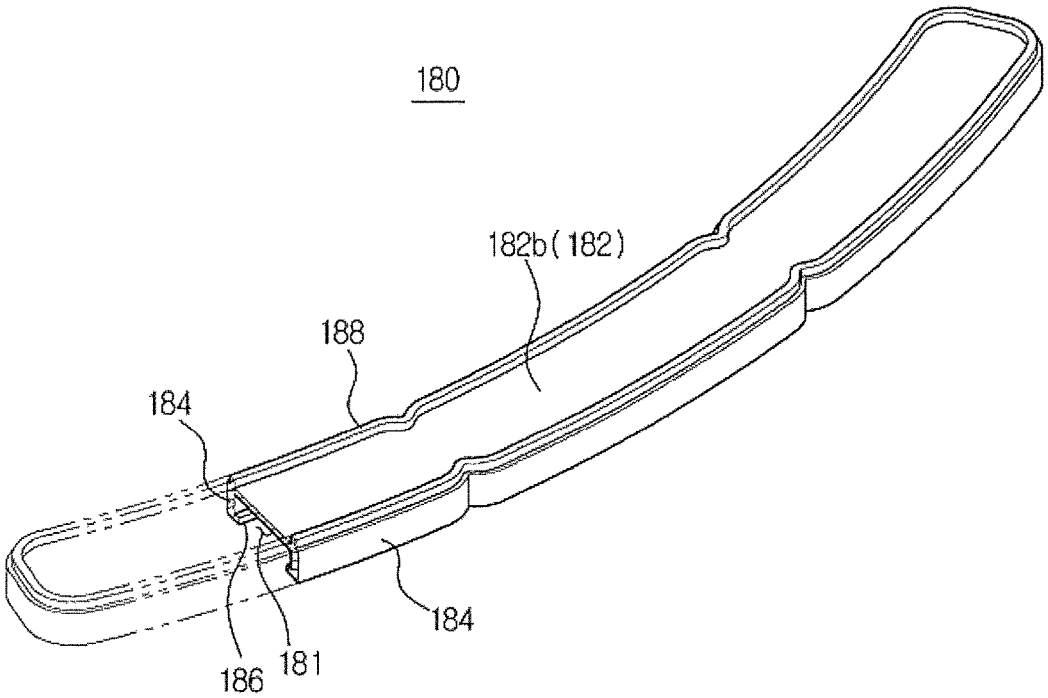
FIG. 11 is a view showing the magnet fixing member according to the embodiment of the present disclosure.
Figure 12:
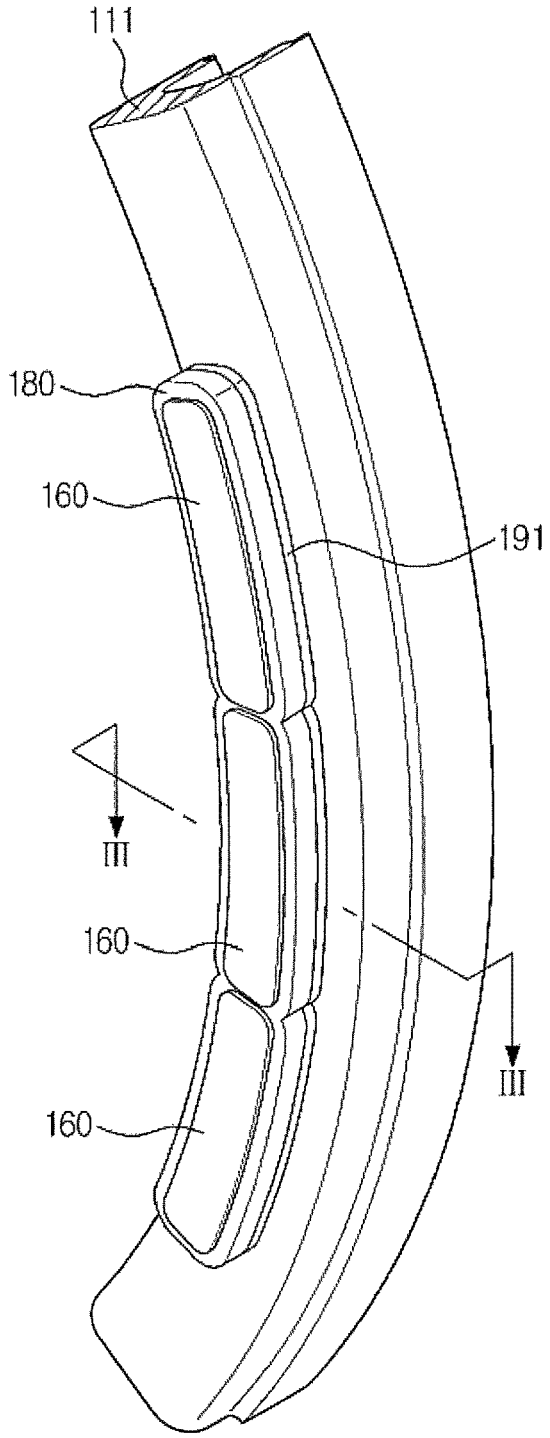
FIG. 12 is a view showing a state in which the magnet fixing member according to the embodiment of the present disclosure is coupled to the balancer housing.
Figure 13:
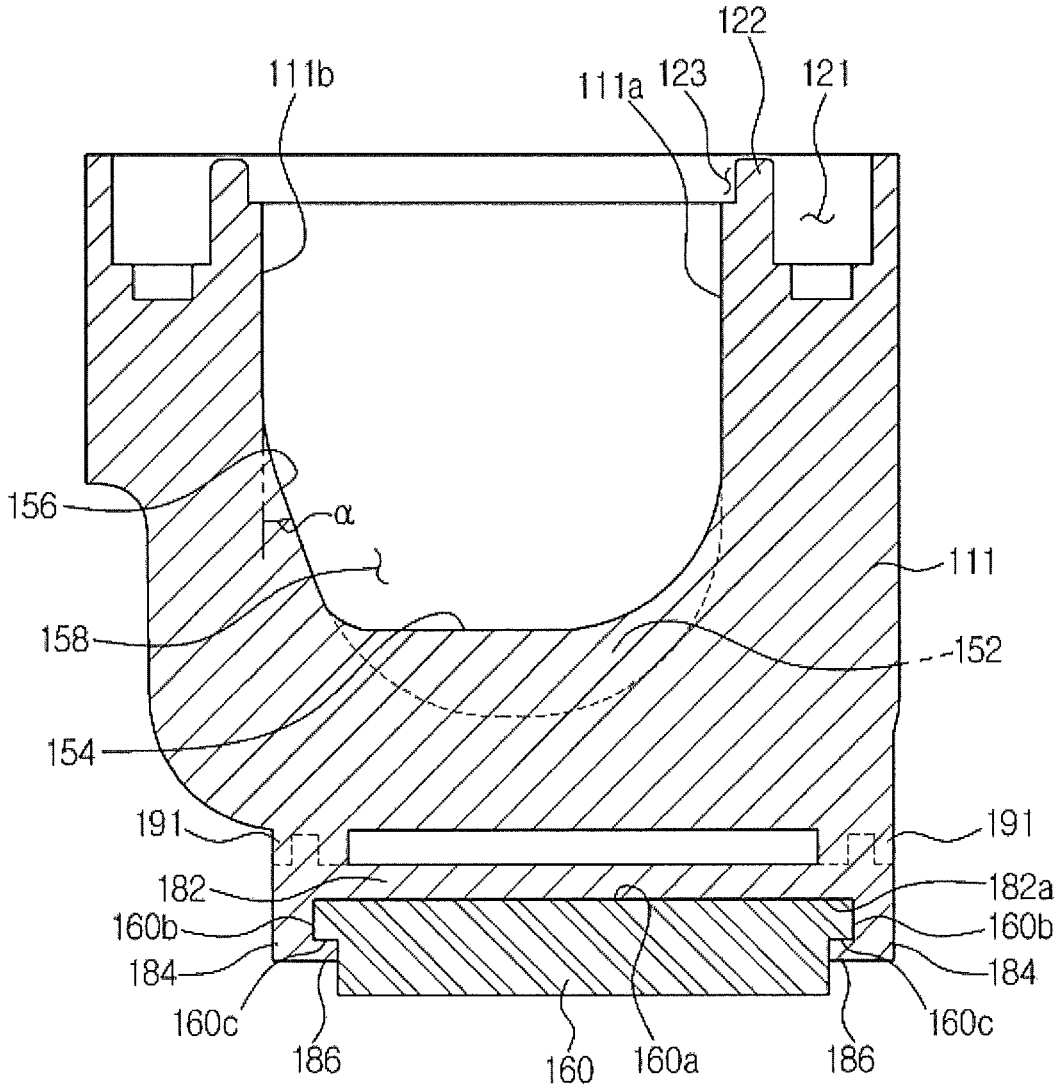
FIG. 13 is a sectional view taken along line of FIG. 12.

FIG. 9 is an exploded perspective view of FIG. 4 when viewed from another angle and FIG. 10 is an enlarged view of part C of FIG. 9 showing a coupling relationship between a magnet fixing member according to an embodiment of the present disclosure and the balancer housing. FIG. 11 is a view showing the magnet fixing member according to the embodiment of the present disclosure, FIG. 12 is a view showing a state in which the magnet fixing member according to the embodiment of the present disclosure is coupled to the balancer housing, and FIG. 13 is a sectional view taken along line III-III of FIG. 12.

As shown in FIGS. 9 to 13, at least one magnet fixing member 180 is coupled to the outside of the balancer housing 110 corresponding to the inner surface of the balancer housing 110 at which the groove 150 is formed.

The magnet fixing member 180 is provided in the shape of a case to receive a plurality of magnets 160 and extends in the circumferential direction of the balancer housing 110.

The magnet fixing member 180 includes a plurality of magnet receiving parts 181 to receive the magnets 160 and a plurality of magnet support parts 182, 184, and 186 to support the magnets 160 received in the magnet receiving parts 181 in at least two directions.

At least two magnet receiving parts 181 are arranged in the circumferential direction of the balancer housing 110.

The magnet support parts 182, 184, and 186 include a first magnet support part 182 to support one major surface 160*a* of each magnet 160, a second magnet support part 184 to support a side surface 160*b* of each magnet 160, and a third magnet support part 186 to support the other major surface 160*c* of each magnet 160 opposite to one major surface 160*a* of each magnet 160.

The first magnet support part 182 is formed in an arc shape corresponding to the shape of the balancer housing 110. The second magnet support part 184 is formed in a shape protruding from one major surface 182*a* of the first magnet support part 182 and surrounding the side surface 160*b* of each magnet 160. The third magnet support part 186 protrudes from the inner surface of the second magnet support part 184 to support the other major surface 160*c* of each magnet 160 such that the magnets 160 are not separated from the magnet receiving parts 181.

The balancer housing 110 includes at least one fixing member fastening part 191 protruding from the rear surface of the first housing 111, to which the magnet fixing member 180 is coupled, in a shape corresponding to the external shape of the magnet fixing member 180. The magnet fixing member 180 includes a welding part 188 protruding from the other major surface 182*b* of the first magnet support part 182 opposite to one major surface 182*a* of the first magnet support part 182, from which the second magnet support part 184 protrudes, in a shape corresponding to the fixing member fastening part 191. In a state in which the magnets 160 are received and fixed in the magnet receiving parts 181, the magnet fixing member 180 is welded to the fixing member fastening part 191 via the welding part 188. Ultrasonic welding or thermal welding may be used as a welding method.

At least two magnet fixing members 180 may be arranged in the circumferential direction of the balancer housing 110 at intervals. For example, a pair of magnet fixing members 180 may be disposed symmetrically on the basis of a virtual line Lr passing through a center of rotation C of the drum 30.

The magnet fixing member 180 is not necessarily coupled to the rear surface of the balancer housing 110. Although not shown, the magnet fixing member 180 may be formed at the front surface of the balancer housing 110 or at the side surface of the balancer housing 110 connected between the front surface and the rear surface of the balancer housing 110.

Each magnet 160 is provided at the side surface 160*b* thereof with a stepped part 164, which is supported by the third magnet support part 186. The stepped part 164 is received in each magnet receiving part 181 to restrain at least one mass 141 received in the groove 150 such that the mass 141 is not separated from the groove 150.

The magnet 160 restrains the mass 141 using magnetic force. Intensity of the magnetic force generated by the magnet 160 is decided based on the number of rotations per minute of the drum 30 when the mass 141 is separated from the groove 150. For example, in order to set the number of rotations per minute of the drum 30 when the mass 141 is separated from the groove 150 to 200 rpm, intensity of the magnetic force generated by the magnet 160 may be adjusted to restrain the mass 141 such that at least one mass 141 received in the groove 150 is not separated from the groove 150 in a case in which the number of rotations per minute of the drum 30 is between 0 and 200 rpm and such that the mass 141 is separated from the groove 150 in a case in which the number of rotations per minute of the drum 30 exceeds 200 rpm. Intensity of the magnetic force generated by the magnet 160 may be adjusted to a desired value based on the size of the magnet 160, the number of the magnets 160, a material of the magnet 160, and a magnetization mode of the magnet 160.

The magnets 160 may be coupled and fixed to the magnet fixing member 180 using an insert injection method in which the magnets are inserted into a mold to manufacture the magnet fixing member 180 by injection molding during manufacture of the magnet fixing member 180.

Figure 14:
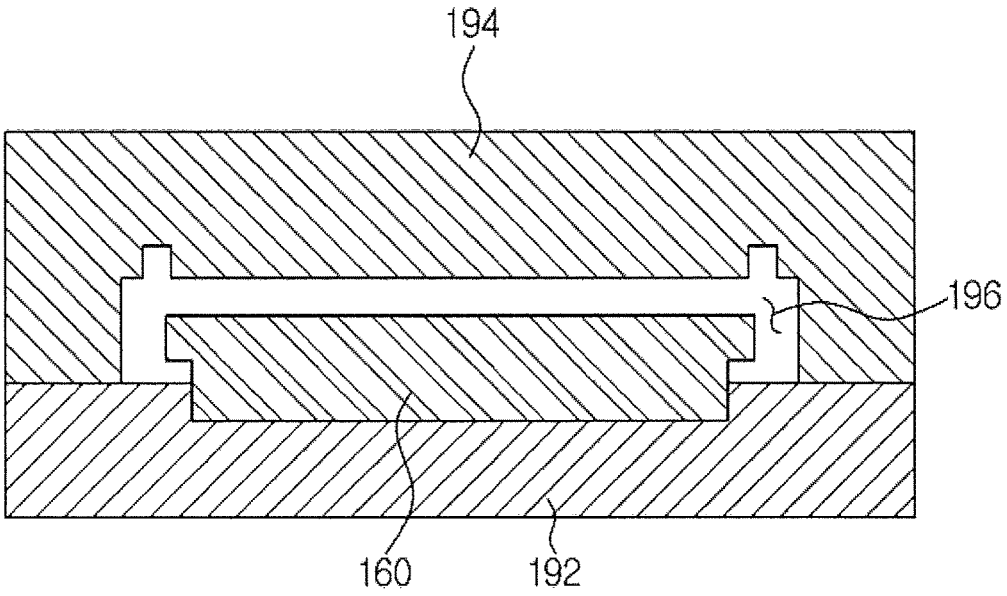
FIGS. 14 to 16 are views showing a process of manufacturing the magnet fixing member according to the embodiment of the present disclosure.
Figure 15:
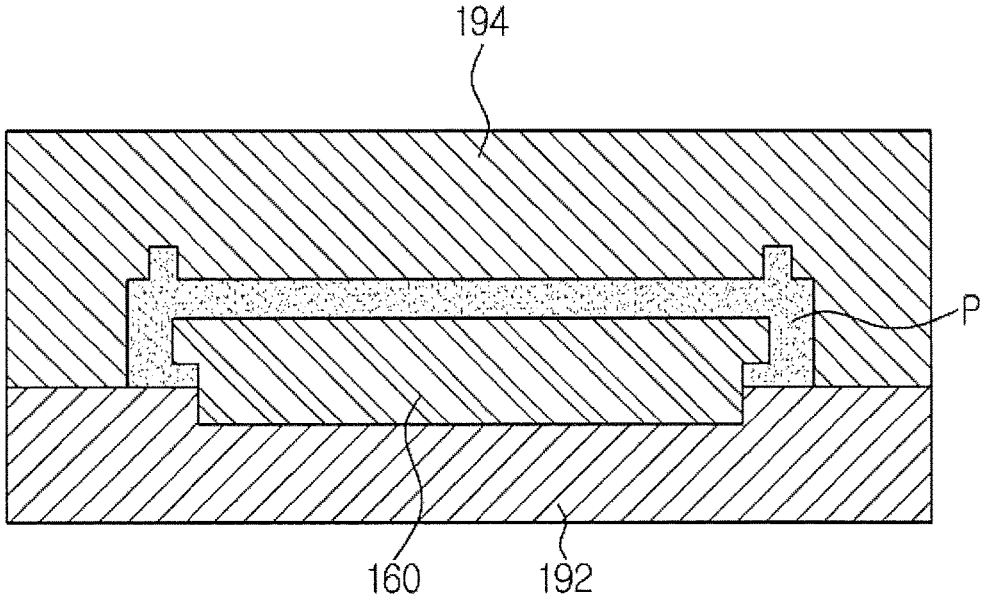
Figure 16:
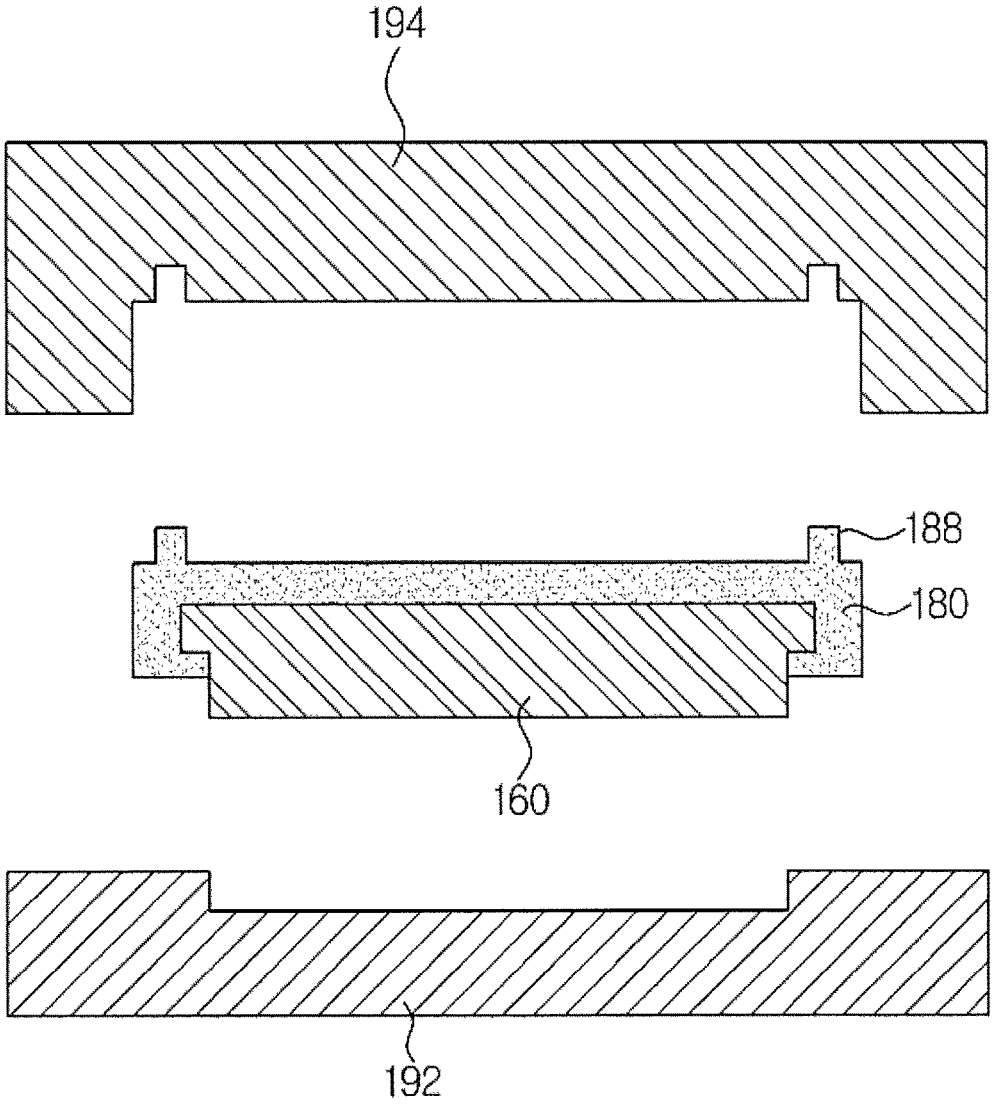

FIGS. 14 to 16 are views showing a process of manufacturing the magnet fixing member according to the embodiment of the present disclosure.

As shown in FIGS. 14 to 16, a first mold 192 and a second mold 194 to mold a magnet fixing member 180 are prepared first. A magnet 160 is inserted into the first mold 192 and then the first mold 192 and the second mold 194 are disposed in tight contact.

Subsequently, a molding resin P is supplied into a cavity 196 defined by the first mold 192 and the second mold 194 until the molding resin P fills the cavity 196.

Subsequently, the molding resin is allowed to stand until fully solidified. At this time, tight contact between the first mold 192 and the second mold 194 is maintained.

After the molding resin is fully solidified to form a magnet fixing member 180, the magnet fixing member 180, to which the magnet 160 is integrally coupled, is separated from the first mold 192 and the second mold 194, thereby completing manufacture of the magnet fixing member 180.

Hereinafter, modifications 280, 380, 480, 580, and 680 of the magnet fixing member 180 will be described. A description of construction identical to that of the magnet fixing member 180 will be omitted.

Figure 17:
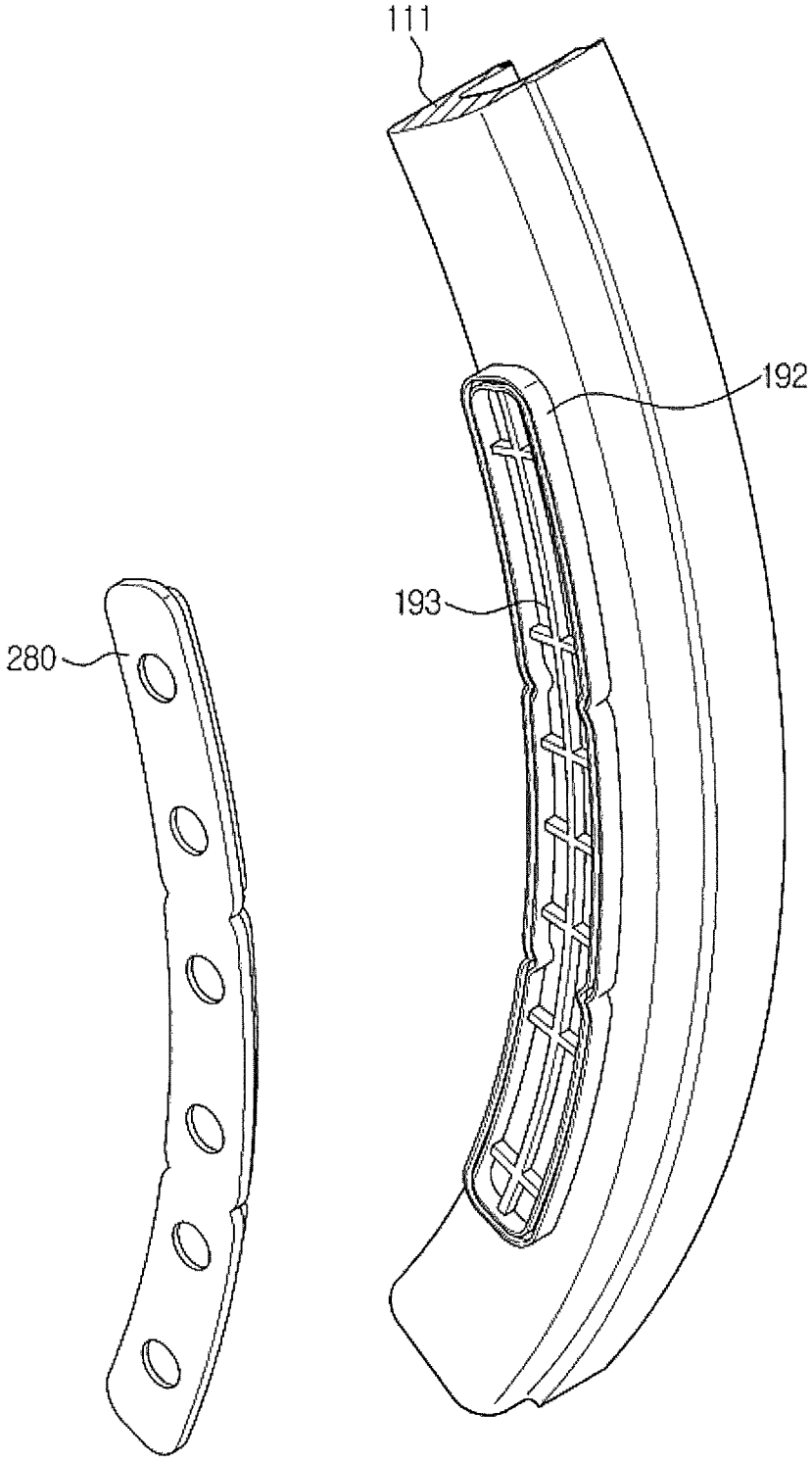
FIG. 17 is a view showing a coupling relationship between a magnet fixing member according to another embodiment of the present disclosure and the balancer housing.
Figure 18:
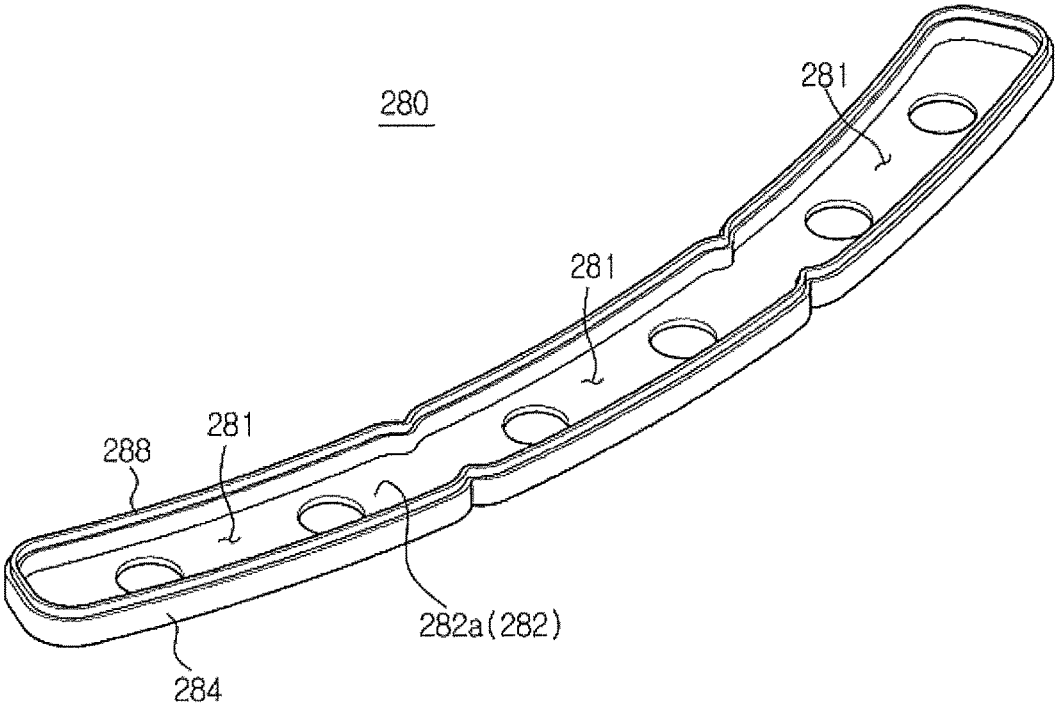
FIG. 18 is a view showing the magnet fixing member according to the embodiment of the present disclosure.
Figure 19:
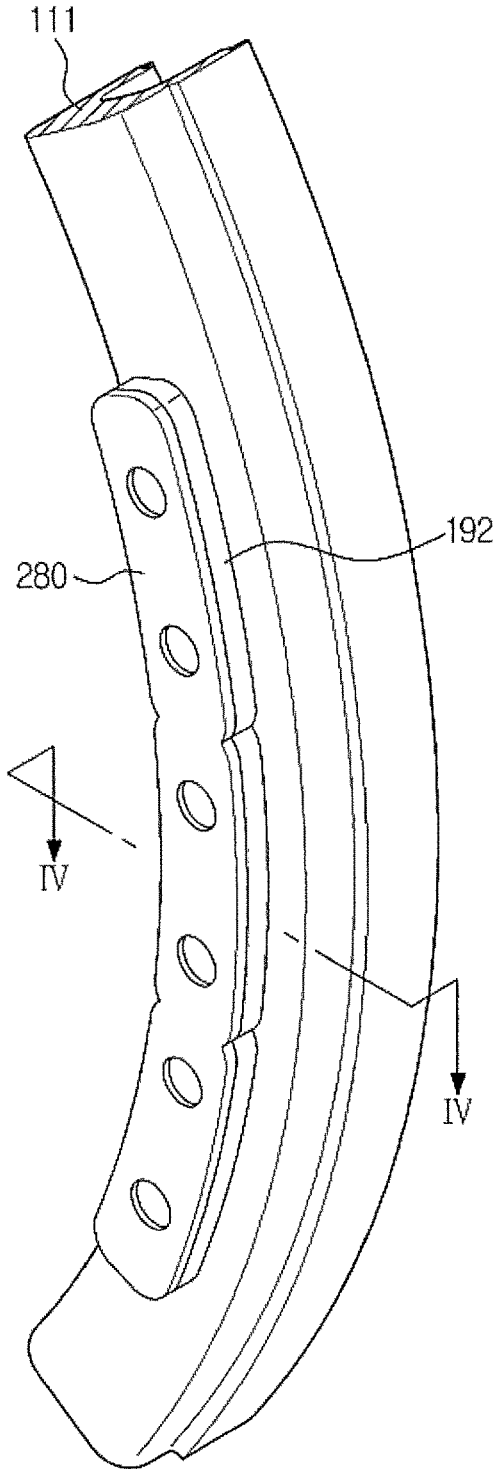
FIG. 19 is a view showing a state in which the magnet fixing member according to the embodiment of the present disclosure is coupled to the balancer housing.
Figure 20:
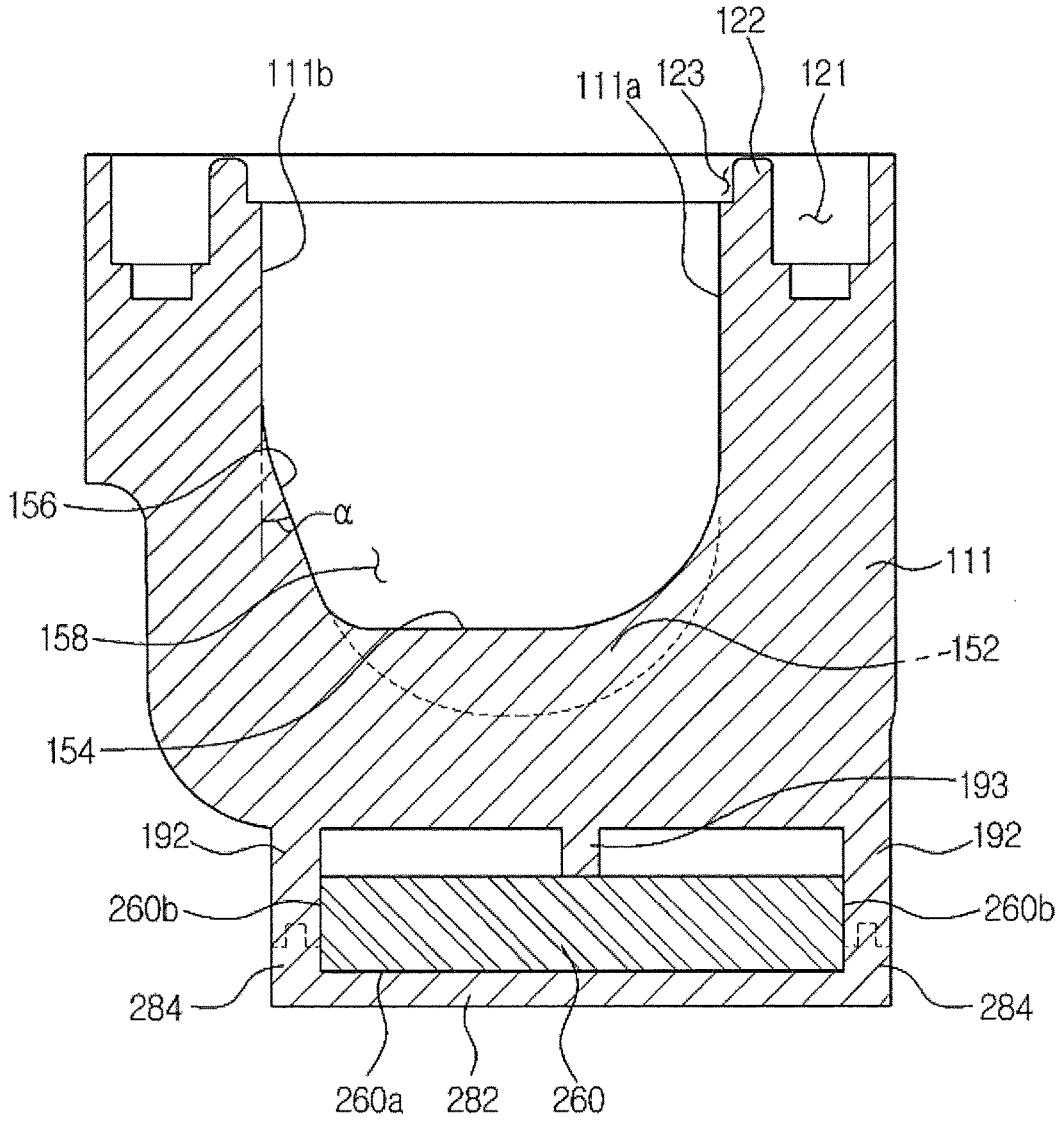
FIG. 20 is a sectional view taken along line IV-IV of FIG. 19.

FIG. 17 is a view showing a coupling relationship between a magnet fixing member according to another embodiment of the present disclosure and the balancer housing and FIG. 18 is a view showing the magnet fixing member according to the embodiment of the present disclosure. FIG. 19 is a view showing a state in which the magnet fixing member according to the embodiment of the present disclosure is coupled to the balancer housing and FIG. 20 is a sectional view taken along line IV-IV of FIG. 19.

As shown in FIGS. 17 to 20, a magnet fixing member 280 includes a plurality of magnet receiving parts 281 to receive magnets 260 and a plurality of magnet support parts 282 and 284 to support the magnets 260 received in the magnet receiving parts 281 in at least two directions.

At least two magnet receiving parts 281 are arranged in the circumferential direction of the balancer housing 110.

The magnet support parts 282 and 284 include a first magnet support part 282 to support one major surface 260*a* of each magnet 260 and a second magnet support part 284 to support a side surface 260*b* of each magnet 260.

The first magnet support part 282 is formed in an arc shape corresponding to the shape of the balancer housing 110. The second magnet support part 284 is formed in a shape protruding from one major surface 282*a* of the first magnet support part 282 and surrounding the side surface 260*b* of each magnet 160.

The balancer housing 110 includes at least one fixing member fastening part 192 protruding from the rear surface of the first housing 111, to which the magnet fixing member 280 is coupled, in a shape corresponding to the external shape of the magnet fixing member 280 and at least one magnet location part 193 protruding from the rear surface of the first housing 111 and disposed in the fixing member fastening part 192.

The magnet fixing member 280 includes a welding part 288 protruding from one end of the second magnet support part 284 in a shape corresponding to the fixing member fastening part 192. In a state in which the magnets 260 are received in the magnet receiving parts 281, the magnet fixing member 280 is welded to the fixing member fastening part 192 via the welding part 288. Ultrasonic welding or thermal welding may be used as a welding method.

Figure 21:
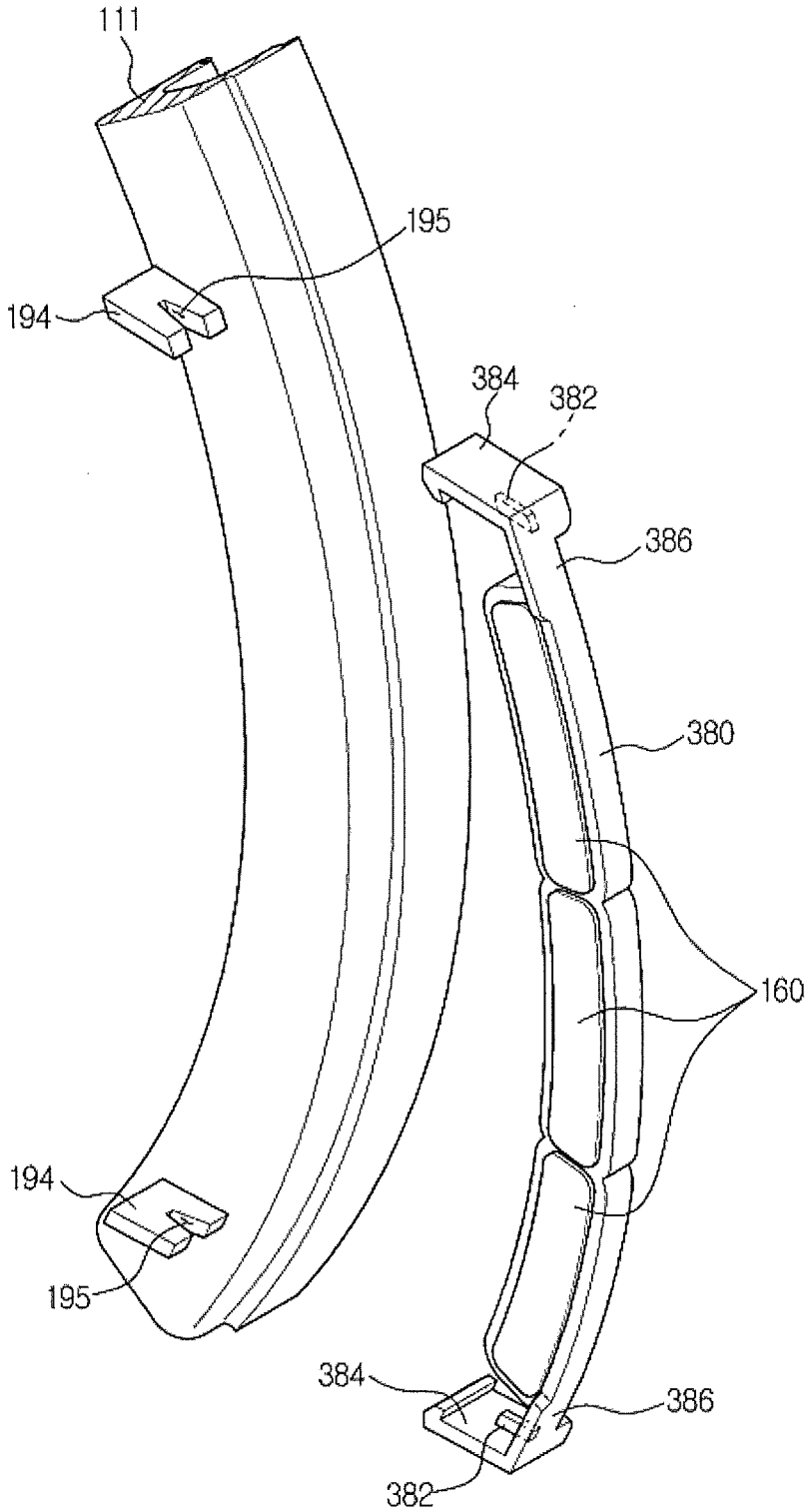
FIG. 21 is a view showing a coupling relationship between a magnet fixing member according to another embodiment of the present disclosure and the balancer housing.
Figure 22:
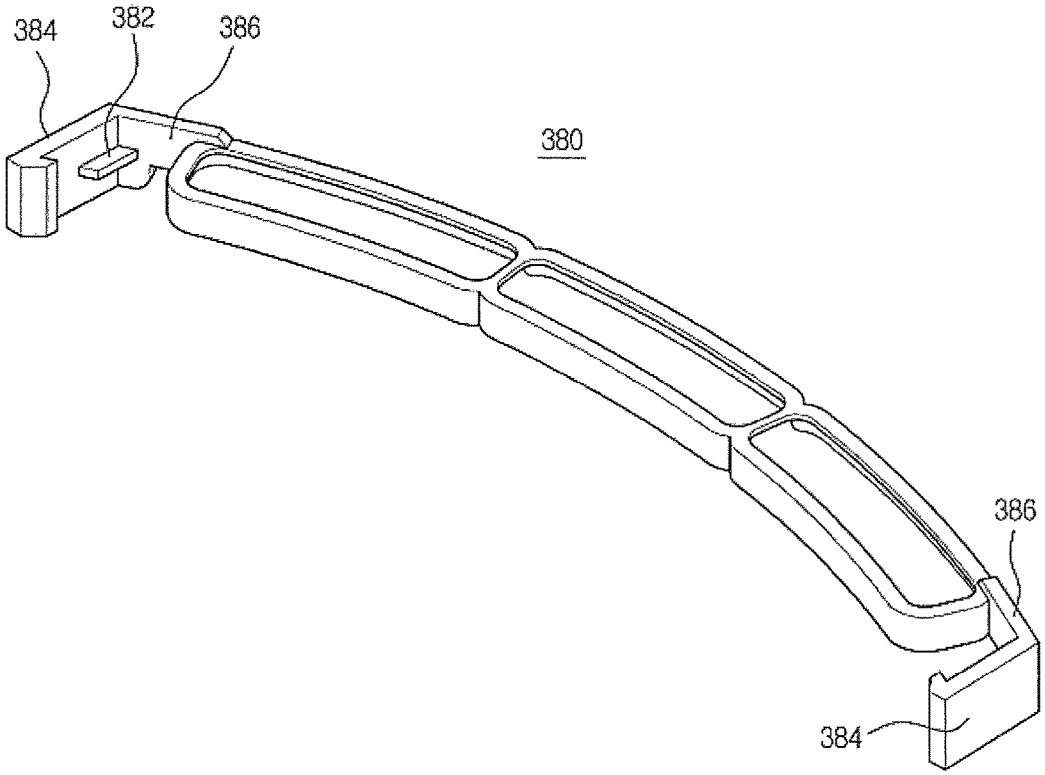
FIG. 22 is a view showing the magnet fixing member according to the embodiment of the present disclosure.
Figure 23:
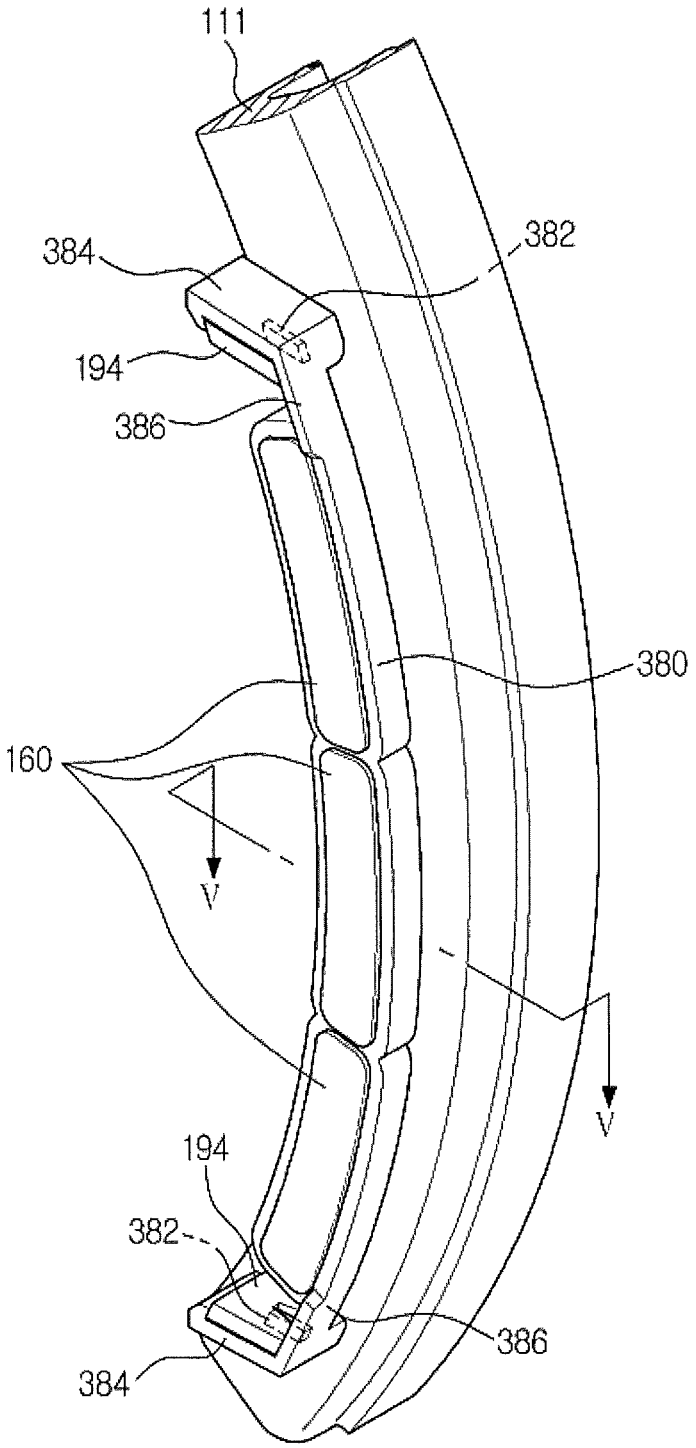
FIG. 23 is a view showing a state in which the magnet fixing member according to the embodiment of the present disclosure is coupled to the balancer housing.
Figure 24:
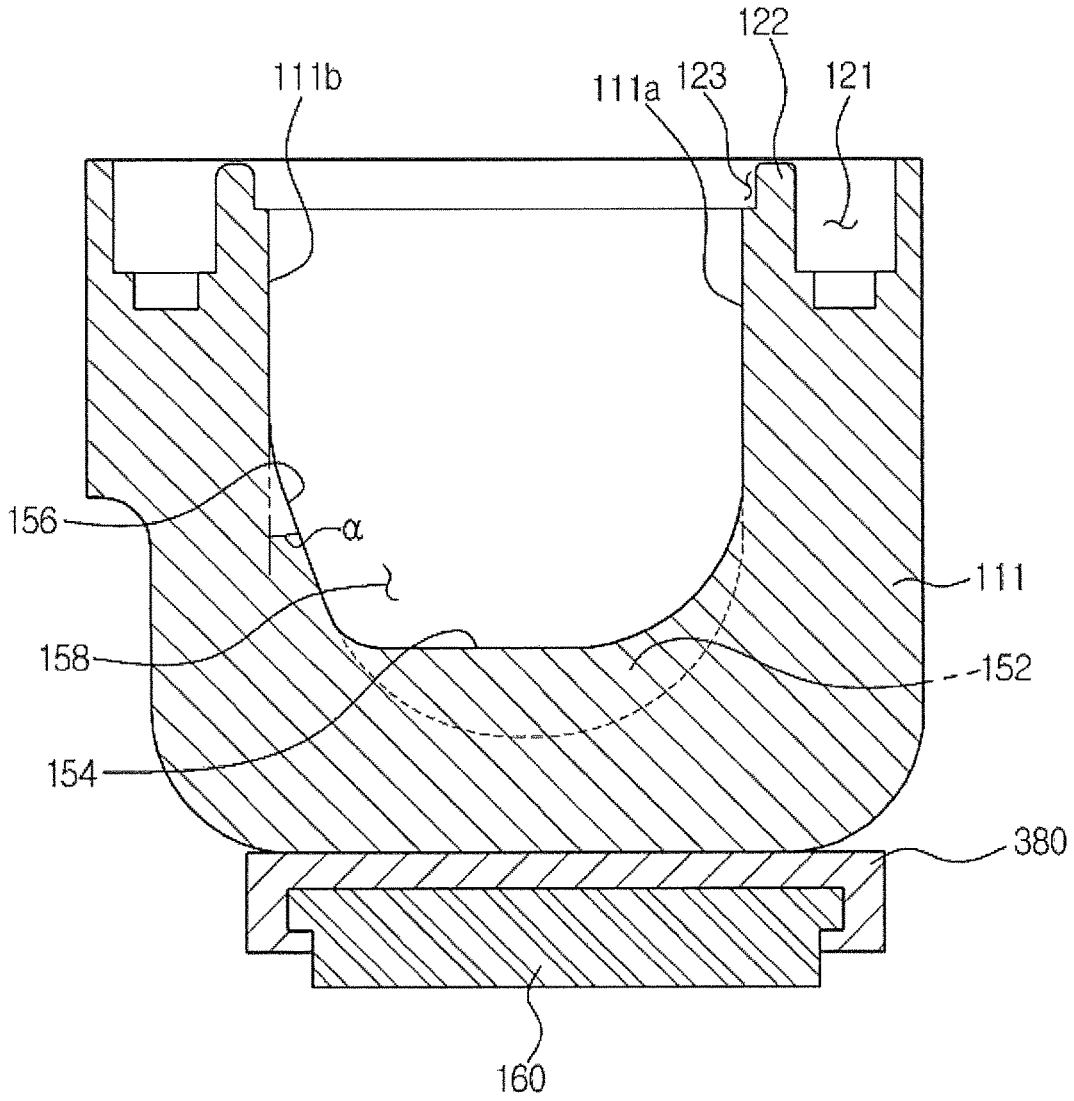
FIG. 24 is a sectional view taken along line V-V of FIG. 23.

FIG. 21 is a view showing a coupling relationship between a magnet fixing member according to another embodiment of the present disclosure and the balancer housing and FIG. 22 is a view showing the magnet fixing member according to the embodiment of the present disclosure. FIG. 23 is a view showing a state in which the magnet fixing member according to the embodiment of the present disclosure is coupled to the balancer housing and FIG. 24 is a sectional view taken along line V-V of FIG. 23.

As shown in FIGS. 21 to 24, a magnet fixing member 380 is coupled to the balancer housing 110 approximately in the radial direction of the balancer housing 110.

The magnet fixing member 380 further includes fastening ribs 382, fastening hooks 384, and connection ribs 386. The connection ribs 386 extend from opposite ends of the magnet fixing member 380 in a circumferential direction of the magnet fixing member 380 and a direction opposite to the circumferential direction of the magnet fixing member 380. The fastening ribs 382 and the fastening hooks 384 extend from the connection ribs 386 in a direction in which the magnet fixing member 380 is coupled to the balancer housing 110.

The balancer housing 110 includes at least one fastening protrusion 194 protruding from the rear surface of the first housing 111 and at least one fastening groove 195 formed by cutting at least a portion of the fastening protrusion 194 in the radial direction of the balancer housing 110. The fastening groove 195 is opened at one side thereof such that a corresponding one of the fastening ribs 382 is inserted into the fastening groove 195.

A corresponding one of the fastening hooks 384 is coupled to the fastening protrusion 194 to prevent the magnet fixing member 380 from being separated from balancer housing 110 in the circumferential direction and outward in the radial direction of the balancer housing 110.

A corresponding one of the fastening ribs 382 is coupled to the fastening groove 195 to prevent the magnet fixing member 380 from being separated from balancer housing 110 in the forward-and-backward direction and inward in the radial direction of the balancer housing 110.

Figure 25:
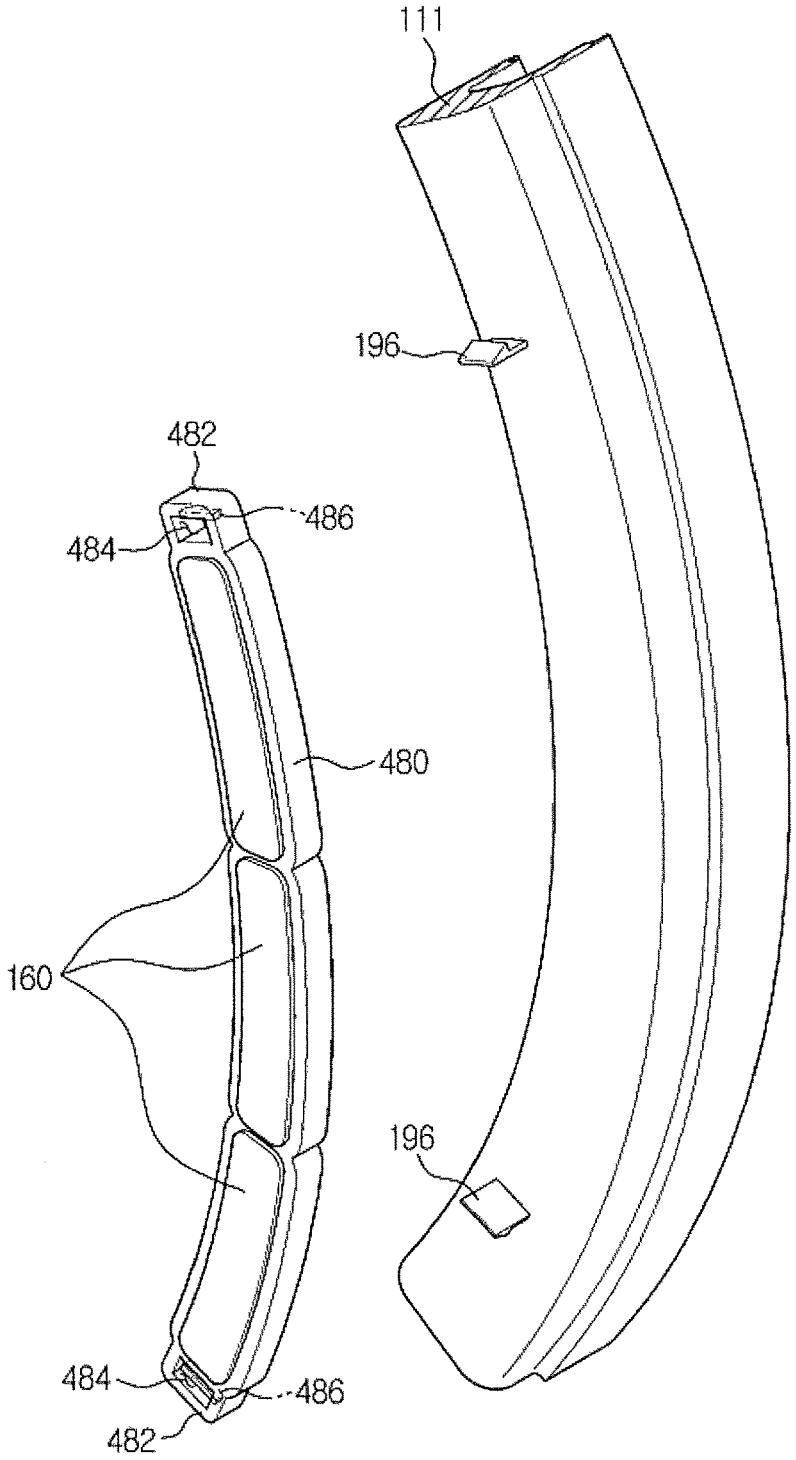
FIG. 25 is a view showing a coupling relationship between a magnet fixing member according to another embodiment of the present disclosure and the balancer housing.
Figure 26:
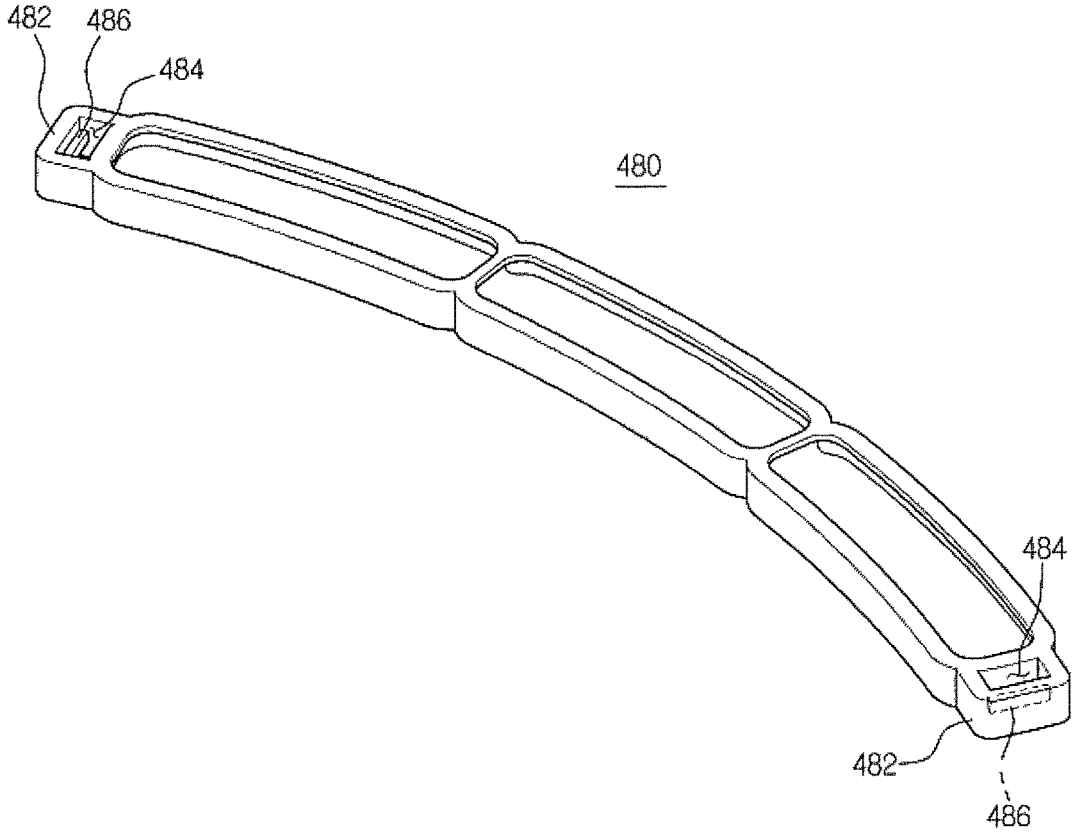
FIG. 26 is a view showing the magnet fixing member according to the embodiment of the present disclosure.
Figure 27:
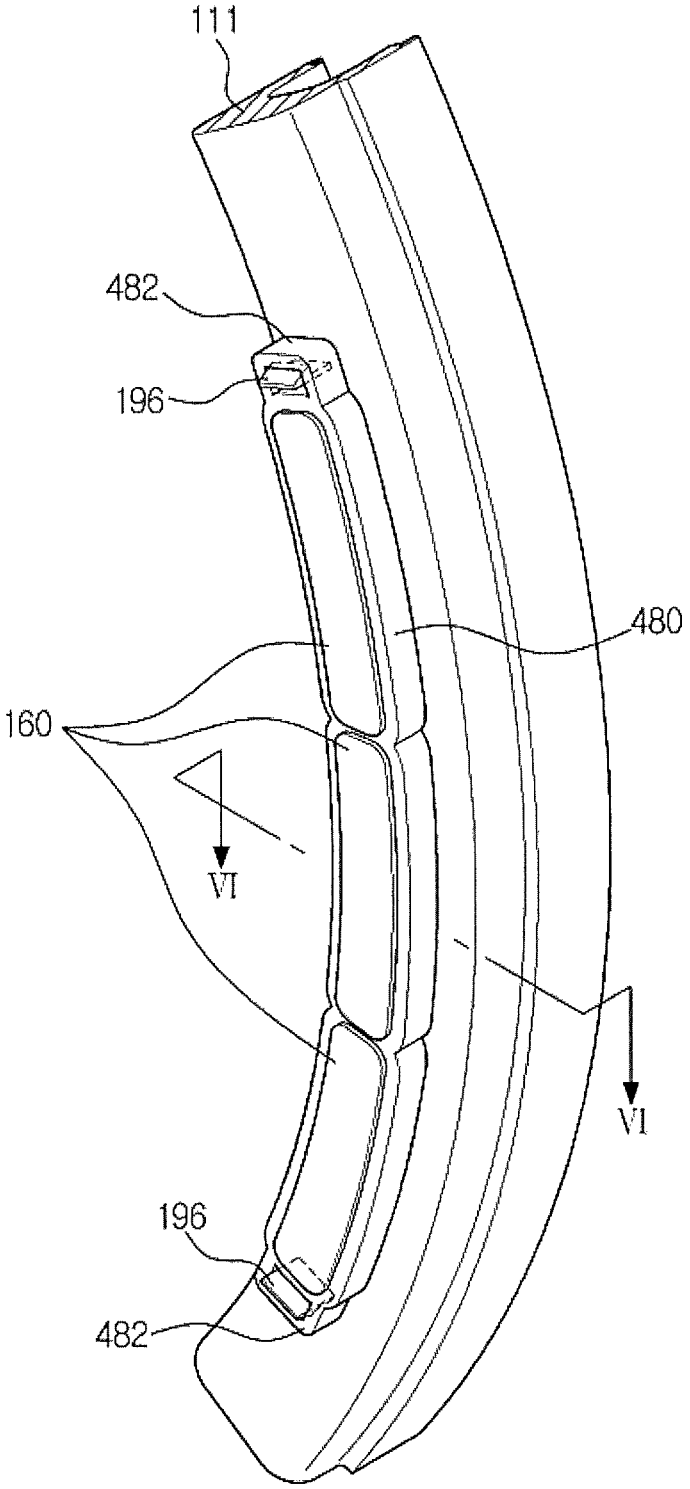
FIG. 27 is a view showing a state in which the magnet fixing member according to the embodiment of the present disclosure is coupled to the balancer housing.
Figure 28:
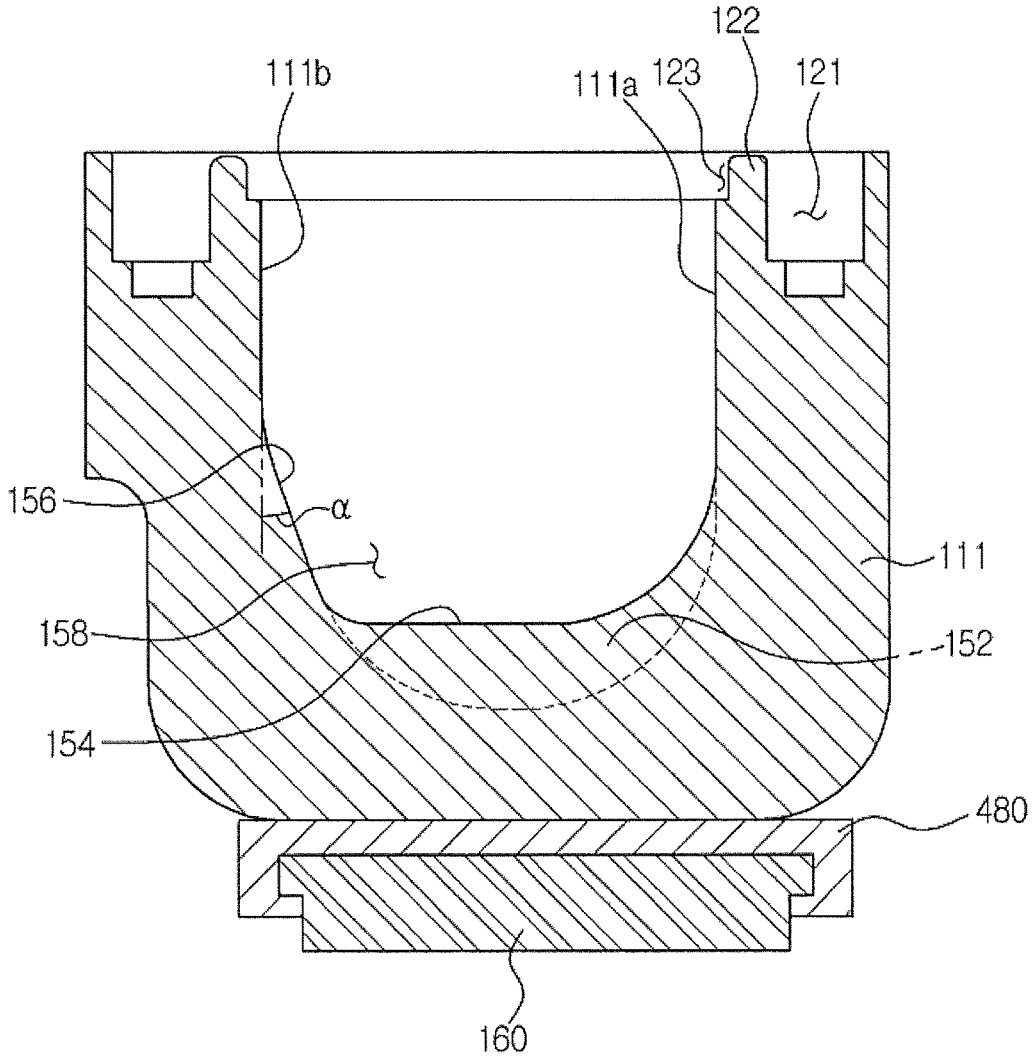
FIG. 28 is a sectional view taken along line VI-VI of FIG. 27.

FIG. 25 is a view showing a coupling relationship between a magnet fixing member according to another embodiment of the present disclosure and the balancer housing and FIG. 26 is a view showing the magnet fixing member according to the embodiment of the present disclosure. FIG. 27 is a view showing a state in which the magnet fixing member according to the embodiment of the present disclosure is coupled to the balancer housing and FIG. 28 is a sectional view taken along line VI-VI of FIG. 27.

As shown in FIGS. 25 to 28, a magnet fixing member 480 is coupled to the balancer housing 110 at the rear of the balancer housing 110 in a direction opposite to the direction in which the balancer housing 110 is coupled to the recess 38.

The magnet fixing member 480 includes a plurality of extension parts 482 extending from opposite ends of the magnet fixing member 480 in a circumferential direction of the magnet fixing member 480 and a direction opposite to the circumferential direction of the magnet fixing member 380 and a plurality of fastening holes 484 formed through the extension parts 482. A support projection 486 is provided at the inside of each fastening hole 484.

The balancer housing 110 includes at least one fastening hook 196 protruding from the rear surface of the first housing 111.

The fastening hook 196 is coupled to a corresponding one of the support projections 486 through a corresponding one of the fastening holes 484 to prevent the magnet fixing member 480 from being separated from the balancer housing 110.

Figure 29:
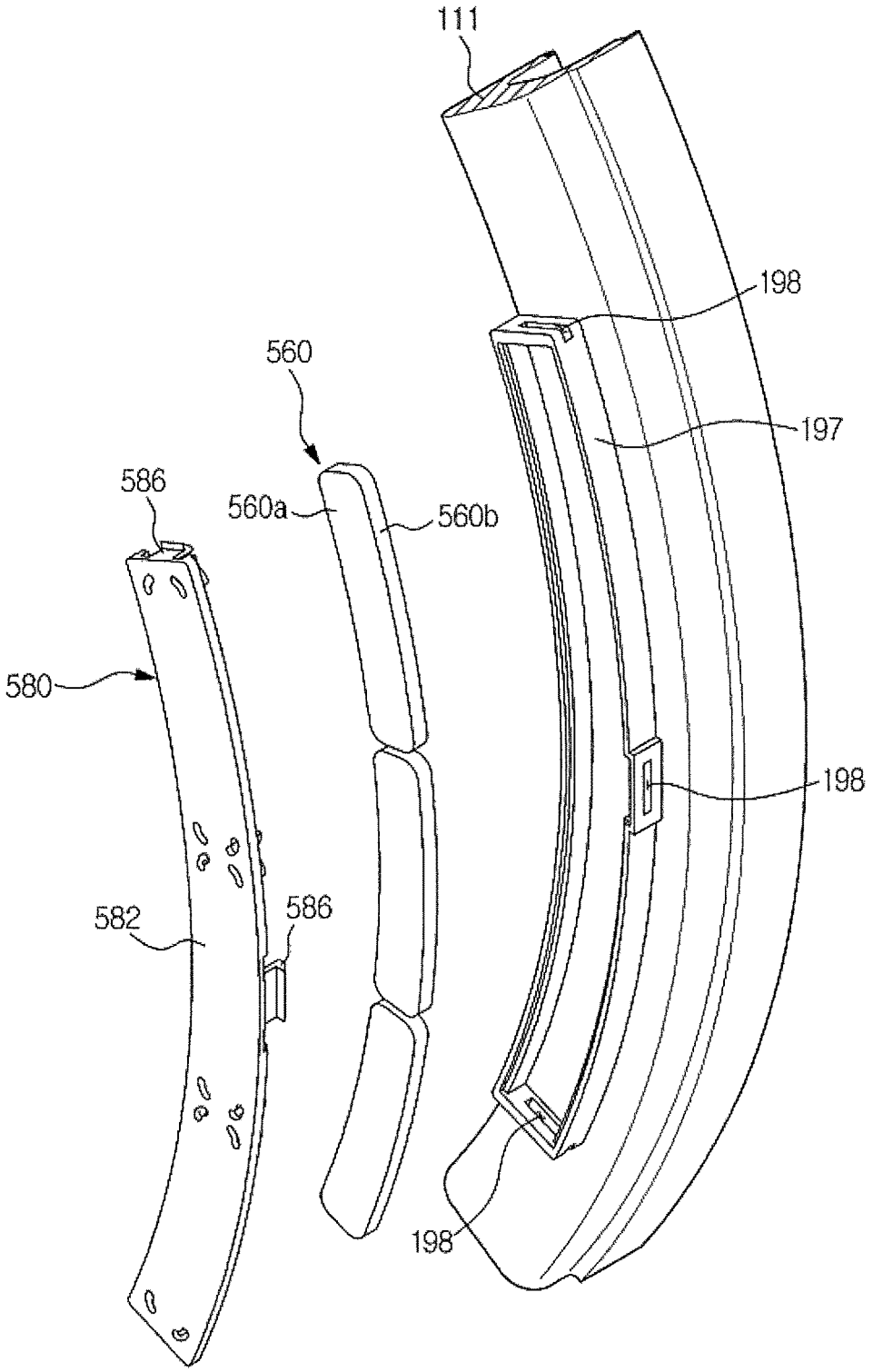
FIG. 29 is a view showing a coupling relationship between a magnet fixing member according to another embodiment of the present disclosure and the balancer housing.
Figure 30:
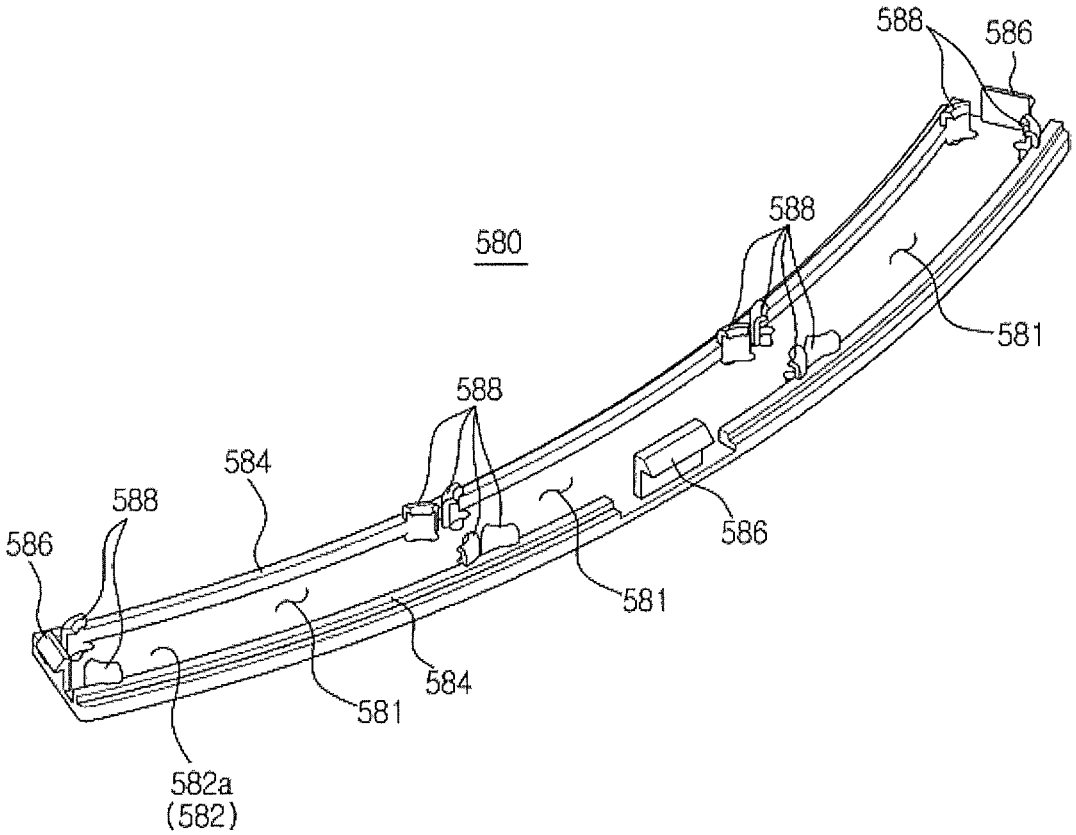
FIG. 30 is a view showing the magnet fixing member according to the embodiment of the present disclosure.
Figure 31:
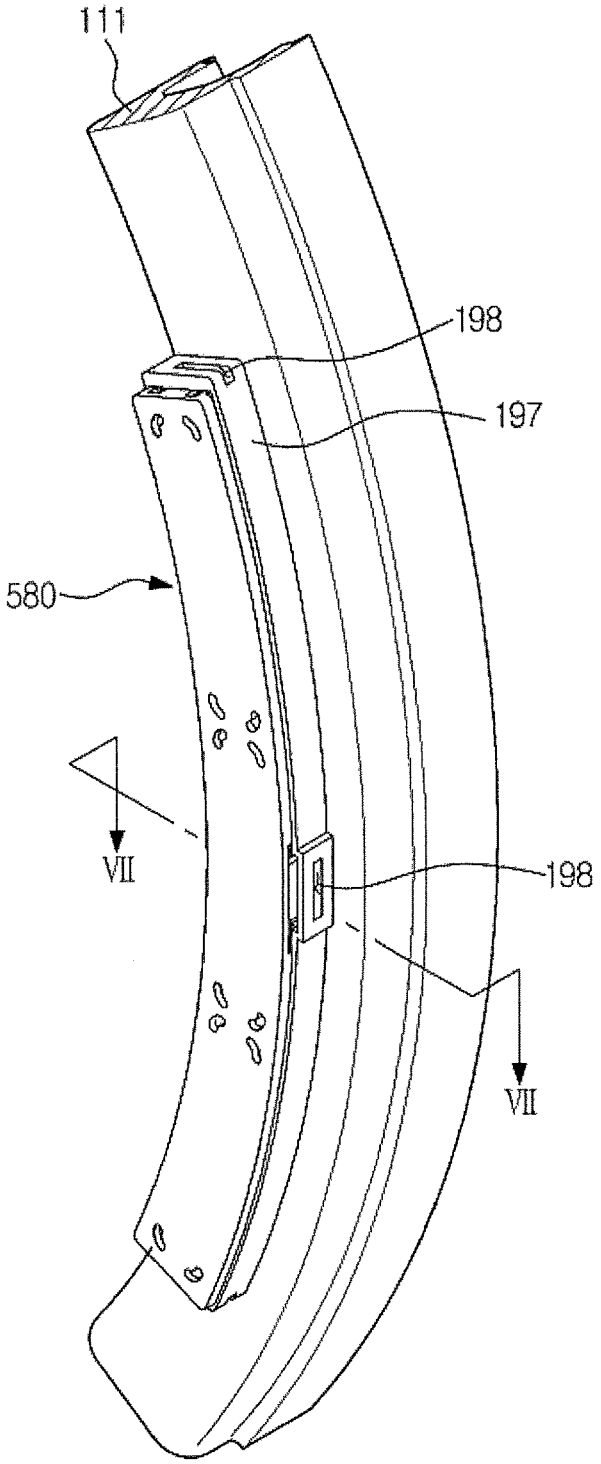
FIG. 31 is a view showing a state in which the magnet fixing member according to the embodiment of the present disclosure is coupled to the balancer housing.
Figure 32:
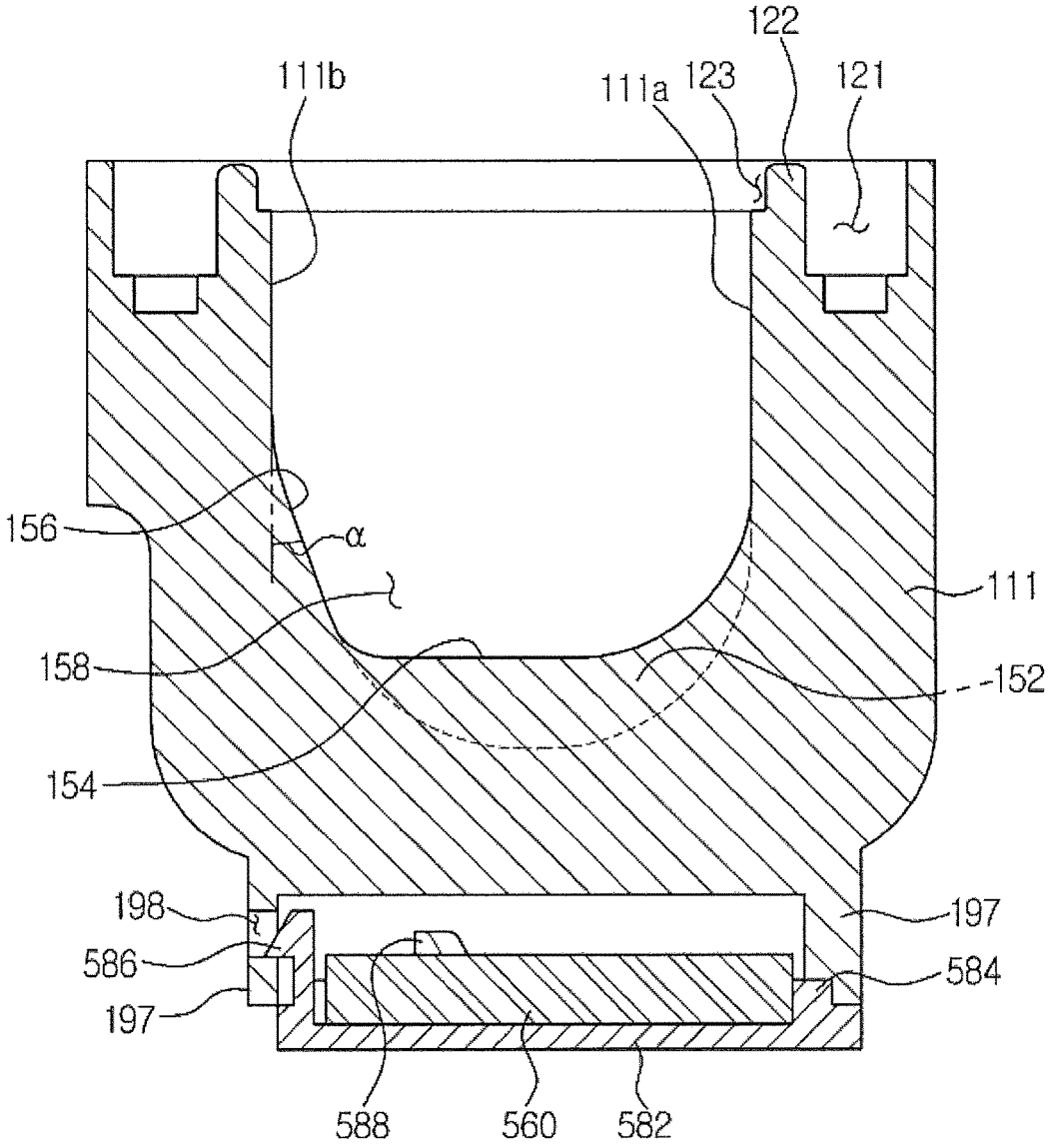
FIG. 32 is a sectional view taken along line VII-VII of FIG. 31.

FIG. 29 is a view showing a coupling relationship between a magnet fixing member according to another embodiment of the present disclosure and the balancer housing and FIG. 30 is a view showing the magnet fixing member according to the embodiment of the present disclosure. FIG. 31 is a view showing a state in which the magnet fixing member according to the embodiment of the present disclosure is coupled to the balancer housing and FIG. 32 is a sectional view taken along line VII-VII of FIG. 31.

As shown in FIGS. 29 to 32, a magnet fixing member 580 is coupled to the balancer housing 110 at the rear of the balancer housing 110 in a direction opposite to the direction in which the balancer housing 110 is coupled to the recess 38.

The magnet fixing member 580 includes a plurality of magnet receiving parts 581 to receive magnets 560, a plurality of magnet support parts 582 and 584 to support the magnets 560 received in the magnet receiving parts 581 in at least two directions, a plurality of magnet fixing hooks 586 to fix the magnets 560, and a plurality of fixing member fastening hooks 588 to couple the magnet fixing member 580 to the balancer housing 110 in a state in which the magnets 560 are received in the magnet receiving parts 581.

At least two magnet receiving parts 581 are arranged in the circumferential direction of the balancer housing 110.

The magnet support parts 582 and 584 include a first magnet support part 582 to support one major surface 560*a* of each magnet 560 and a second magnet support part 584 to support a side surface 560*b* of each magnet 560.

The first magnet support part 582 is formed in an arc shape corresponding to the shape of the balancer housing 110. The second magnet support part 584 is formed in a shape protruding from one major surface 582*a* of the first magnet support part 582 and surrounding the side surface 560*b* of each magnet 560.

The magnet fixing hooks 586 are arranged along the second magnet support part 584 at intervals to uniformly fix the magnets 560 received in the magnet receiving parts 581. The fixing member fastening hooks 588 extend from the end of the second magnet support part 584 in a direction in which the magnet fixing member 580 is coupled to the balancer housing 110.

The balancer housing 110 includes at least one fixing member fastening part 197 protruding from the rear surface of the first housing 111, to which the magnet fixing member 580 is coupled, in a shape corresponding to the external shape of the magnet fixing member 580 and at least one fixing member fastening groove 198 formed at the side surface of the fixing member fastening part 197.

A corresponding one of the fixing member fastening hooks 588 is coupled to the fixing member fastening groove 198 to prevent the magnet fixing member 580 from being separated from the balancer housing 110.

Figure 33:
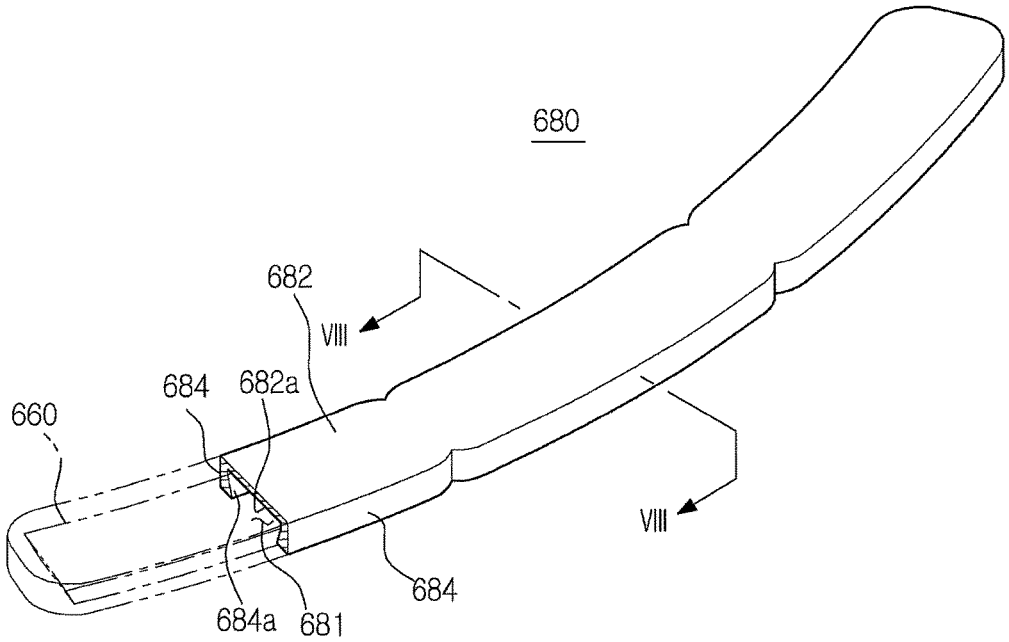
FIG. 33 is a view showing a magnet fixing member according to a further embodiment of the present disclosure.
Figure 34:
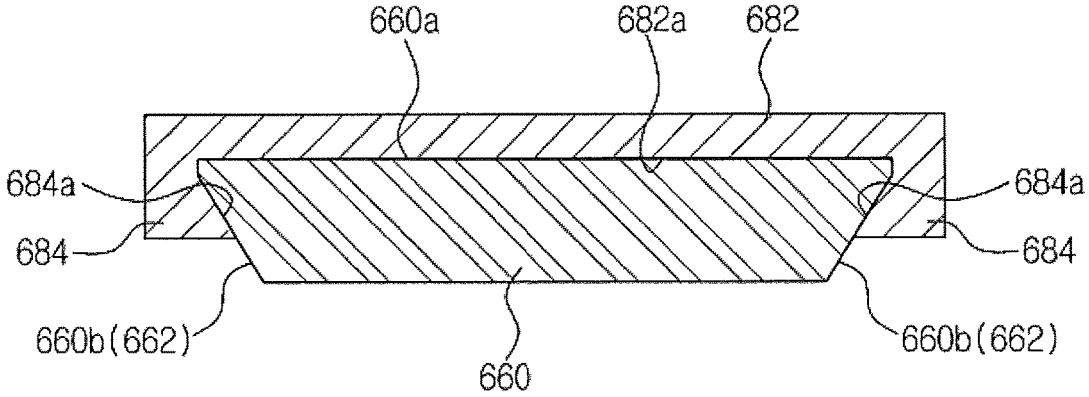
FIG. 34 is a sectional view showing a state in which a magnet is coupled to the magnet fixing member shown in FIG. 33.

FIG. 33 is a view showing a magnet fixing member according to a further embodiment of the present disclosure and FIG. 34 is a sectional view showing a state in which a magnet is coupled to the magnet fixing member shown in FIG. 33

As shown in FIG. 33, a magnet fixing member 680 includes a plurality of magnet receiving parts 681 to receive magnets 660 and a plurality of magnet support parts 682 and 684 to support the magnets 660 received in the magnet receiving parts 681 in at least two directions.

The magnet support parts 682 and 684 include a first magnet support part 682 to support one major surface 660*a* of each magnet 660 and a second magnet support part 684 to support a side surface 660*b* of each magnet 660. The first magnet support part 682 is formed in an arc shape corresponding to the shape of the balancer housing 110. The second magnet support part 684 is formed in a shape protruding from one major surface 682*a* of the first magnet support part 682 and surrounding the side surface 660*b* of each magnet 660.

In order to prevent the magnets 660 from being separated from the magnet receiving parts 681, the width of the second magnet support part 684 is gradually increased in a protruding direction of the second magnet support part 684. That is, an inner surface 684*a* of the second magnet support part 684 contacting the side surface 660*b* of each magnet 660 is inclined. Each magnet 660 is provided at the side surface 660*b* thereof with an inclined part 662, which is supported by the second magnet support part 684.

The magnets 660 may be inserted into a mold to manufacture the magnet fixing member 680 by injection molding during manufacture of the magnet fixing member 680.

In a manner similar to the coupling between the magnet fixing members according to the previous embodiments of the present disclosure and the balancer housing as described above, the magnet fixing member 680 may be coupled to the balancer housing 110 by ultrasonic welding, thermal welding, or hook coupling.

Figure 35:
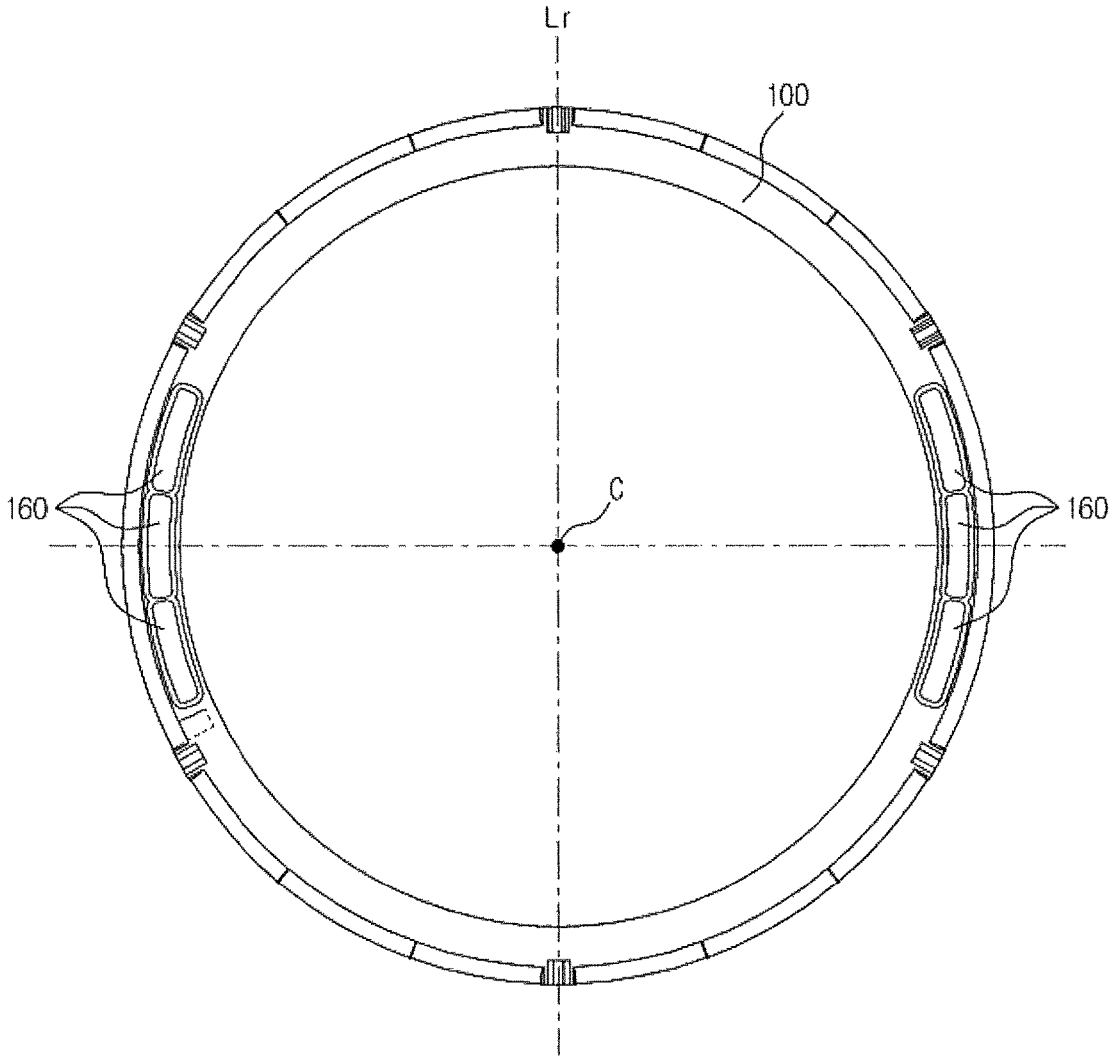
FIG. 35 is a view showing a structure in which magnets are disposed on the balancer housing.

FIG. 35 is a view showing a structure in which magnets are disposed on the balancer housing. Specifically, FIG. 35 is a view of the balancer housing when viewed from the rear of the balancer housing.

As shown in FIG. 35, a pair of magnets 160 may be disposed symmetrically on the basis of a virtual line Lr passing through a center of rotation C of the drum 30 and perpendicular to the ground at positions corresponding to the grooves 150.

It is assumed that the number of rotations per minute of the drum 30 does not exceed 200 rpm and thus the masses 141 may be restrained by the magnets 160 as described above. In a case in which the number of magnets 160 is three or more, if the masses 141 are restrained between two neighboring magnets 160, the masses 141 may not move to the remaining magnets 160. Consequently, the masses 141 may not be uniformly distributed in the balancer housing 110 with the result that unbalanced load may be generated in the drum 30.

In a case in which a pair of magnets 160 is disposed symmetrically on the basis of the virtual line Lr passing through the center of rotation C of the drum 30, if corresponding masses 141 are received in any one of the grooves, the remaining masses 141 may be naturally received in the other groove during rotation of the drum 30 and then restrained by the magnets 160. Consequently, nonuniform distribution of the masses 141 in the balancer housing 110 is prevented.

Hereinafter, a principle in which the masses 141 are restrained by the grooves 150 and the magnets 160 when the number of rotations per minute of the drum 30 is within a predetermined range and the masses 141 are separated from the grooves 150 when the number of rotations per minute of the drum 30 deviates from the predetermined range to balance the drum 30 will be described.

Figure 36:
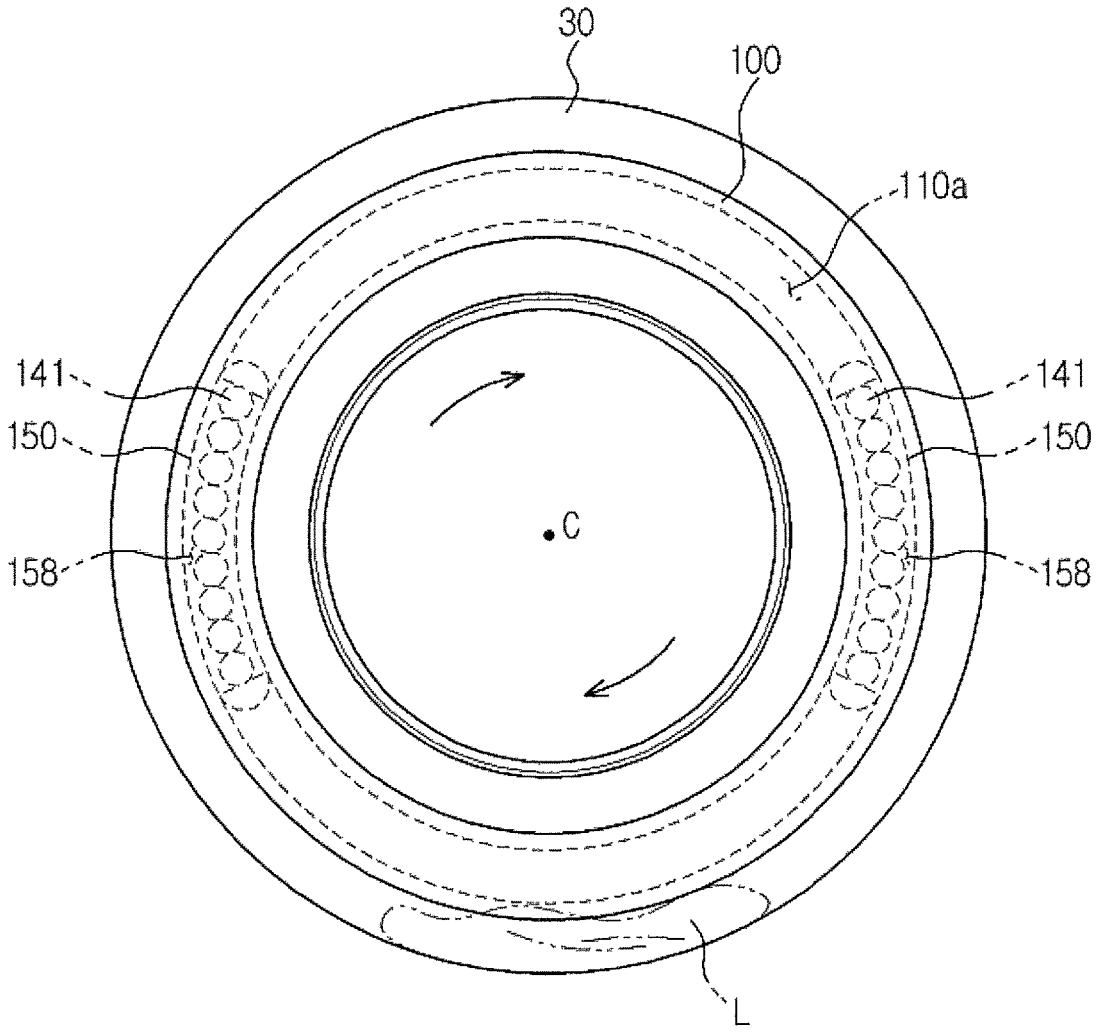
FIGS. 36 and 37 are views showing an operating principle of the balancer according to the embodiment of the present disclosure.
Figure 37:
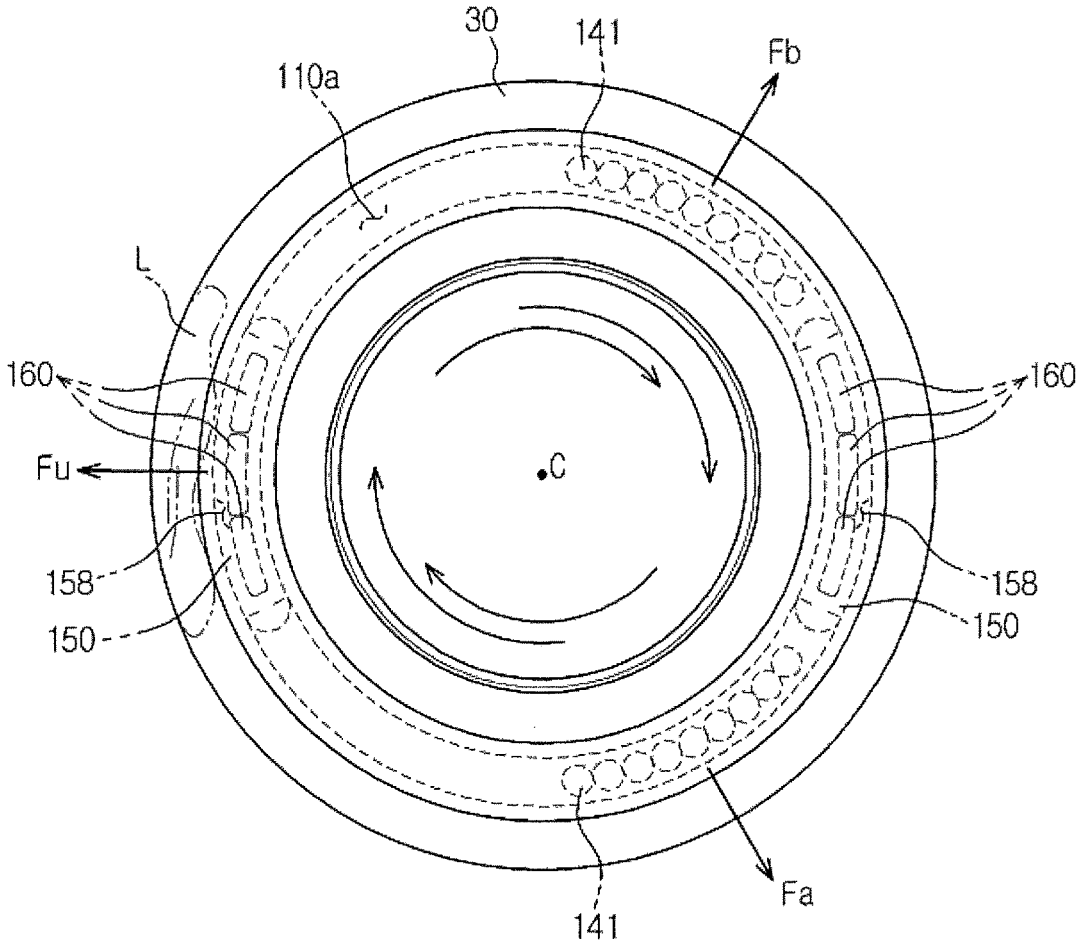

FIGS. 36 and 37 are views showing an operating principle of the balancer according to the embodiment of the present disclosure. A damping fluid 170 is omitted from FIGS. 36 and 37.

As shown in FIG. 36, when the number of rotations per minute of the drum 30 is within a predetermined range at the beginning of spin-drying of laundry, the masses 141 are received in the grooves 150 or the section increase portions 158 and movement of the masses 141 is restrained by the magnets 160.

Before spin-drying is commenced, i.e. before the drum 30 is rotated, the masses 141 are disposed at the lower part of the balancer housing 110 due to gravity. When the drum 30 is rotated to spin-dry the laundry in this state, centrifugal force is applied to the masses 141. As a result, the masses 141 move along the channel 110*a* of the balancer housing 110. During movement of the masses 141 along the channel 110*a* of the balancer housing 110, the masses 141 are received and located in the grooves 150. The movement of the masses 141 received and located in the grooves 150 is restrained by magnetic force generated by the magnets 160 before the number of rotations per minute of the drum 30 deviates from a predetermined range. For example, in a case in which the washing machine is designed such that when the number of rotations per minute of the drum 30 is 200 rpm, centrifugal force applied to the masses 141 by rotation of the drum 30, force generated by the masses 141 due to gravity, magnetic force generated by the magnets 160, and force generated by the grooves 150 to support the masses 141 are balanced, the movement of the masses 141 is restrained in a state in which the masses 141 are received and located in the grooves 150 when the number of rotations per minute of the drum 30 is between 0 and 200 rpm at the beginning of spin-drying of laundry. As described above, the movement of the masses 141 is restrained when the drum 30 is rotated at relatively low speed at the beginning of spin-drying of laundry to prevent the masses 141 from generating vibration of the drum 30 together with laundry L or to prevent the increase of vibration generated by the laundry L. In addition, noise due to vibration of the drum 30 may be reduced.

When the number of rotations per minute of the drum 30 deviates from the predetermined range, as shown in FIG. 37, the masses 141 received and restrained in the grooves 150 or the section increase portions 158 are separated from the grooves 150 or the section increase portions 158 and move along the channel 110*a* of the balancer housing 110 to perform a balancing function of the drum 30.

For example, in a case in which the washing machine is designed such that when the number of rotations per minute of the drum 30 is 200 rpm, centrifugal force applied to the masses 141 by rotation of the drum 30, force generated by the masses 141 due to gravity, magnetic force generated by the magnets 160, and force generated by the grooves 150 to support the masses 141 are balanced, the centrifugal force applied to the masses 141 is increased when the number of rotations per minute of the drum 30 exceeds 200 rpm. As a result, the masses 141 are separated from the grooves 150 or the section increase portions 158 and move along the channel 110*a* of the balancer housing 110. At this time, the masses 141 are controlled to slide and roll in a direction to offset unbalanced load Fu generated in the drum 30 due to one-side accumulation of the laundry L, i.e. a direction opposite to the direction in which the unbalanced load Fu is applied to the drum 30. Consequently, forces Fa and Fb to offset the unbalanced load Fu are generated to stabilize rotation of the drum 30.

As is apparent from the above description, the balancer effectively offsets unbalanced load applied to the drum, thereby stabilizing rotation of the drum.

In addition, vibration and noise are prevented from being generated from the drum due to the masses provided to balance the drum before the drum reaches predetermined rotational speed.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A balancer mounted to a drum of a washing machine to offset unbalanced load generated in the drum during rotation of the drum, the balancer comprising:

a balancer housing coupled to an annular recess of the drum, the balancer housing having an annular channel defined therein;

at least one mass movably disposed in the annular channel;

at least one groove formed on an inner surface of the balancer housing and accommodating the at least one mass;

at least one magnet disposed between the balancer housing and the annular recess of the drum to restrain movement of the at least one mass along the annular channel when rotational speed of the drum is within a predetermined range;

at least one magnet fixing member to receive and fix the at least one magnet on one major surface of the at least one magnet fixing member, the at least one magnet fixing member including a welding part protruding from an other major surface of the at least one magnet fixing member opposite to the one major surface; and at least one fixing member fastening part protruding from an outer surface of the balancer housing in a shape corresponding to an external shape of the at least one magnet fixing member, the at least one magnet fixing member being welded to the at least one fixing member fastening part via the welding part, wherein the at least one fixing member fastening part protrudes from the outer surface of the balancer housing opposite to the inner surface of the balancer housing in which the at least one groove is formed, at a position corresponding to the at least one groove.

2. The balancer according to claim 1, wherein the at least one magnet fixing member is among two or more magnet fixing members arranged in a circumferential direction of the balancer housing at intervals.

3. The balancer according to claim 1, wherein the at least one magnet fixing member extends in a circumferential direction of the balancer housing to receive two or more magnets.

4. The balancer according to claim 1, wherein the at least one magnet fixing member is among two or more magnet fixing members disposed symmetrically on the basis of a virtual line passing through a center of rotation of the drum.

5. The balancer according to claim 1, wherein the balancer housing comprises:

a first housing opened at one side thereof; and a second housing to cover the first housing to define the annular channel, and the at least one magnet fixing member is coupled to an outside of the first housing.

6. The balancer according to claim 1, wherein the at least one magnet fixing member is coupled to a rear surface of the balancer housing opposite to a front surface of the drum.

7. The balancer according to claim 6, wherein the at least one magnet fixing member comprises:

a first magnet support part to support the one major surface of the at least one magnet; and a second magnet support part protruding from the first magnet support part to support a side surface of the at least one magnet.

8. The balancer according to claim 7, wherein the second magnet support part has a width gradually increasing in a protruding direction of the second magnet support part.

9. The balancer according to claim 8, wherein the magnet is provided at the side surface thereof with an inclined part supported by the second magnet support part.

10. The balancer according to claim 7, comprising a third magnet support part protruding from an inner surface of the second magnet support part to support the other major surface of the at least one magnet opposite to the one major surface of the at least one magnet.

11. The balancer according to claim 10, wherein the at least one magnet is provided at the side surface thereof with a stepped part supported by the third magnet support part.

12. The balancer according to claim 1, further comprising at least one fixing member fastening groove provided at the at least one fixing member fastening part, wherein the at least one magnet fixing member comprises at least one fixing member fastening hook coupled to the at least one fixing member fastening groove.

13. The balancer according to claim 12, wherein the at least one magnet fixing member comprises a first magnet support part to support the one major surface of the at least one magnet and a second magnet support part protruding from the first magnet support part to support a side surface of the at least one magnet, and the fixing member fastening hook extends from an end of the second magnet support part in a direction in which the at least one magnet fixing member is coupled to the balancer housing.

14. The balancer according to claim 13, wherein the at least one magnet fixing member comprises a plurality of magnet fixing hooks to fix the at least one magnet received therein, and the magnet fixing hooks are arranged along the second magnet support part at intervals.

15. The balancer according to claim 1, wherein the at least one magnet is inserted into a mold to form the at least one magnet fixing member.

16. A washing machine comprising:

a cabinet;

a drum rotatably disposed in the cabinet;

an annular recess provided at the drum; and a balancer to offset unbalanced load generated in the drum during rotation of the drum, wherein the balancer comprises a balancer housing mounted in the annular recess, the balancer housing having an annular channel defined therein;

at least one mass movably disposed in the annular channel;

at least one groove formed on an inner surface of the balancer housing and accommodating the at least one mass;

at least one magnet disposed between the balancer housing and the annular recess to restrain the at least one mass when rotational speed of the drum is within a predetermined range;

at least one magnet case to receive the at least one magnet on one major surface of the at least one magnet case, the at least one magnet case including a welding part protruding from an other major surface of the at least one magnet case opposite to the one major surface; and at least one fastening part protruding from an outer surface of the balancer housing in a shape corresponding to an external shape of the at least one magnet case, the at least one magnet case being welded to the at least one fastening part via the welding part, wherein the at least one fastening part protrudes from the outer surface of the balancer housing opposite to the inner surface of the balancer housing in which the at least one groove is formed, at a position corresponding to the at least one groove.

17. The washing machine according to claim 16, wherein the at least one magnet case is coupled and fixed to a rear surface of the balancer housing opposite to the annular recess.

18. The washing machine according to claim 17, wherein the at least one magnet case comprises:

at least one magnet receiving part to receive the at least one magnet; and a plurality of magnet support parts to support the at least one magnet received in the at least one magnet receiving part in at least two directions.

19. The washing machine according to claim 18, wherein at least one magnet support part among the plurality of magnet support parts comprises:

a first magnet support part to support the one major surface of the at least one magnet; and a second magnet support part protruding from the first magnet support part to support a side surface of the at least one magnet.

20. The washing machine according to claim 19, wherein the second magnet support part has an inclined inner surface.

21. The washing machine according to claim 19, wherein the second magnet support part has a stepped inner surface.

22. The washing machine according to claim 16, comprising:

two or more magnet receiving parts arranged in a circumferential direction of the at least one magnet case.

23. The washing machine according to claim 16, wherein the at least one magnet case is coupled to the balancer housing in a radial direction of the balancer housing.

24. The washing machine according to claim 16, wherein the at least one magnet case is coupled to the balancer housing in a direction opposite to a direction in which the balancer housing is coupled to the annular recess.

25. A balancer mounted to a rotating body, the balancer comprising:

a balancer housing, the balancer housing having an annular channel defined therein;

at least one mass movably disposed in the annular channel;

at least one groove formed on an inner surface of the balancer housing and accommodating the at least one mass;

at least one magnet configured to restrain the at least one mass when rotational speed of the rotating body is within a predetermined range;

at least one magnet case to receive the at least one magnet on one major surface of the at least one magnet case, the at least one magnet case including a welding part protruding from an other major surface of the at least one magnet case opposite to the one major surface; and at least one fastening part protruding from an outer surface of the balancer housing in a shape corresponding to an external shape of the at least one magnet case, the at least one magnet case being welded to the at least one fastening part via the welding part, wherein the at least one fastening part protrudes from the outer surface of the balancer housing opposite to the inner surface of the balancer housing in which the at least one groove is formed, at a position corresponding to the at least one groove.

26. The balancer according to claim 25, wherein the at least one magnet case comprises:

at least one magnet receiving part to receive the at least one magnet; and a plurality of magnet support parts to support the at least one magnet received in the at least one magnet receiving part in at least two directions.

27. The balancer according to claim 26, wherein the plurality of magnet support parts comprise:

a first magnet support part to support the one major surface of the at least one magnet; and a second magnet support part protruding from the first magnet support part to support a side surface of the at least one magnet.

28. The balancer according to claim 27, wherein the second magnet support part has an inclined inner surface.

29. The balancer according to claim 27, wherein the second magnet support part has a stepped inner surface.

30. The balancer according to claim 25, wherein the at least one magnet case is coupled to the balancer housing in a radial direction of the balancer housing.

* * * * *